US007934917B2

(12) United States Patent
Chu et al.

(10) Patent No.: US 7,934,917 B2
(45) Date of Patent: May 3, 2011

(54) APPARATUS FOR ELECTRO-BLOWING OR BLOWING-ASSISTED ELECTRO-SPINNING TECHNOLOGY

(75) Inventors: Benjamin Chu, Setauket, NY (US); Benjamin S. Hsiao, Setauket, NY (US); Dufei Fang, East Setauket, NY (US)

(73) Assignee: The Research Foundation of State University of New York, Albany, NY (US)

( * ) Notice: Subject to any disclaimer, the term of this patent is extended or adjusted under 35 U.S.C. 154(b) by 0 days.

(21) Appl. No.: 12/235,996

(22) Filed: Sep. 23, 2008

(65) Prior Publication Data

US 2009/0123591 A1 May 14, 2009

Related U.S. Application Data

(62) Division of application No. 10/936,568, filed on Sep. 9, 2004, now Pat. No. 7,887,311.

(51) Int. Cl.
*D01D 7/00* (2006.01)

(52) U.S. Cl. .... 425/7; 425/72.2; 425/83.1; 425/174.8 E; 425/227; 425/382.2; 425/464

(58) Field of Classification Search ..... 425/7, 72.2, 425/83.1, 174.8 E, 226, 227, 228, 380, 381, 425/382.2, 464, 466, 467
See application file for complete search history.

(56) References Cited

U.S. PATENT DOCUMENTS

| | | | | |
|---|---|---|---|---|
| 2,810,426 | A * | 10/1957 | Till et al. | 264/438 |
| 3,121,254 | A * | 2/1964 | Heynen et al. | 425/464 |
| 3,975,475 | A * | 8/1976 | Foley | 264/28 |
| 4,127,706 | A * | 11/1978 | Martin et al. | 429/122 |
| 4,968,238 | A * | 11/1990 | Satterfield et al. | 425/135 |
| 6,336,801 | B1 * | 1/2002 | Fish et al. | 425/7 |

* cited by examiner

*Primary Examiner* — Matthew J Daniels
*Assistant Examiner* — Joseph Leyson
(74) *Attorney, Agent, or Firm* — Oblon, Spivak, McClelland, Maier & Neustadt, L.L.P.

(57) ABSTRACT

A spinneret format, an electric-field reversal format and a process for post-treatment of membranes formed from electro-spinning or electro-blowing are provided, including a cleaning method and apparatus for electro-blowing or blowing-assisted electro-spinning technology.

11 Claims, 16 Drawing Sheets

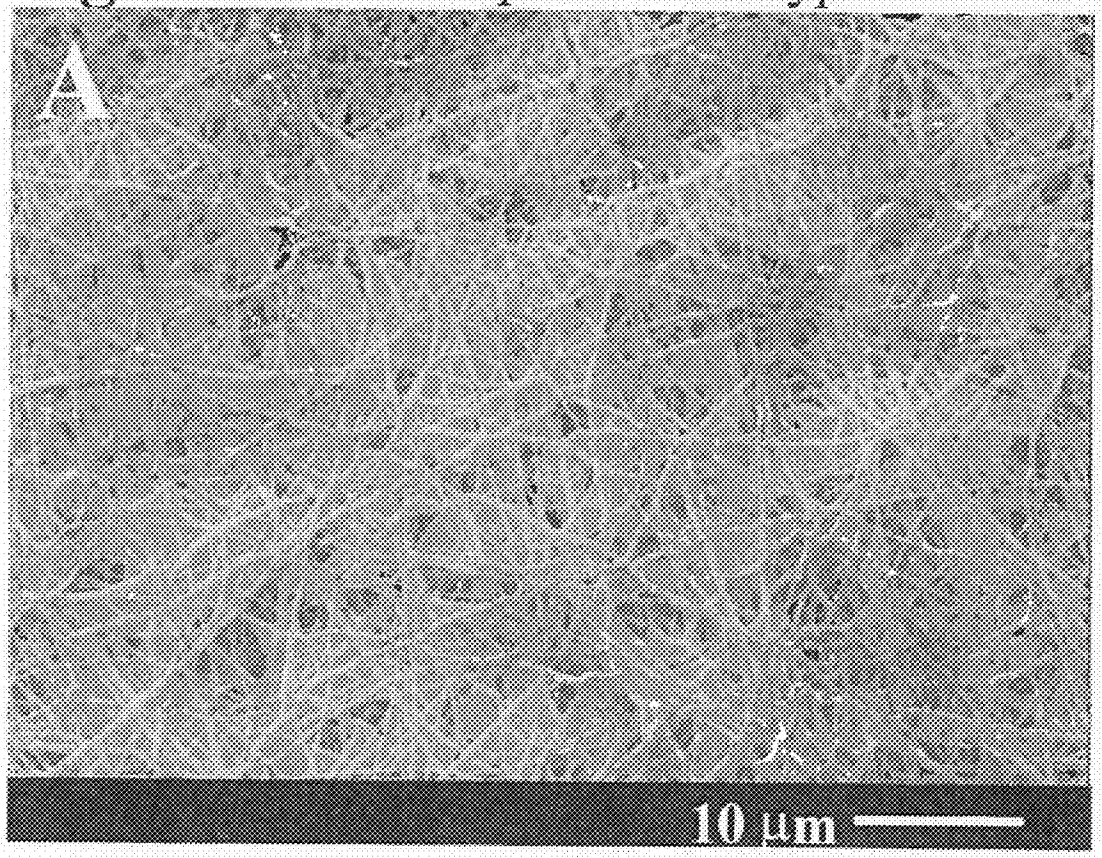
Figure 22. SEM picture of a typical electrospun PLGA membrane

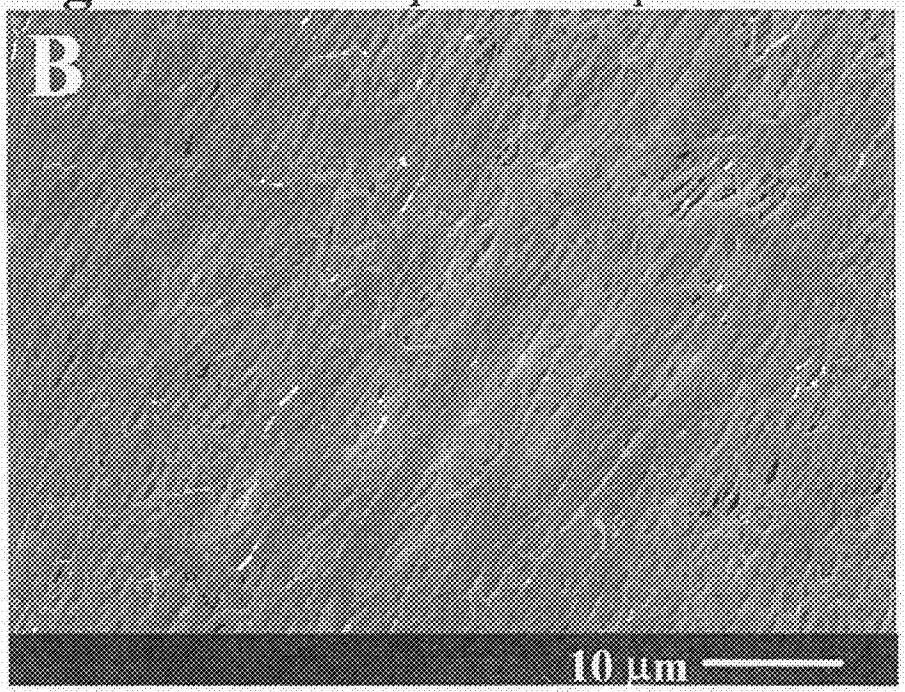
Figure 23. SEM picture of a post-annealed and uniaxially drawn PLGA membrane

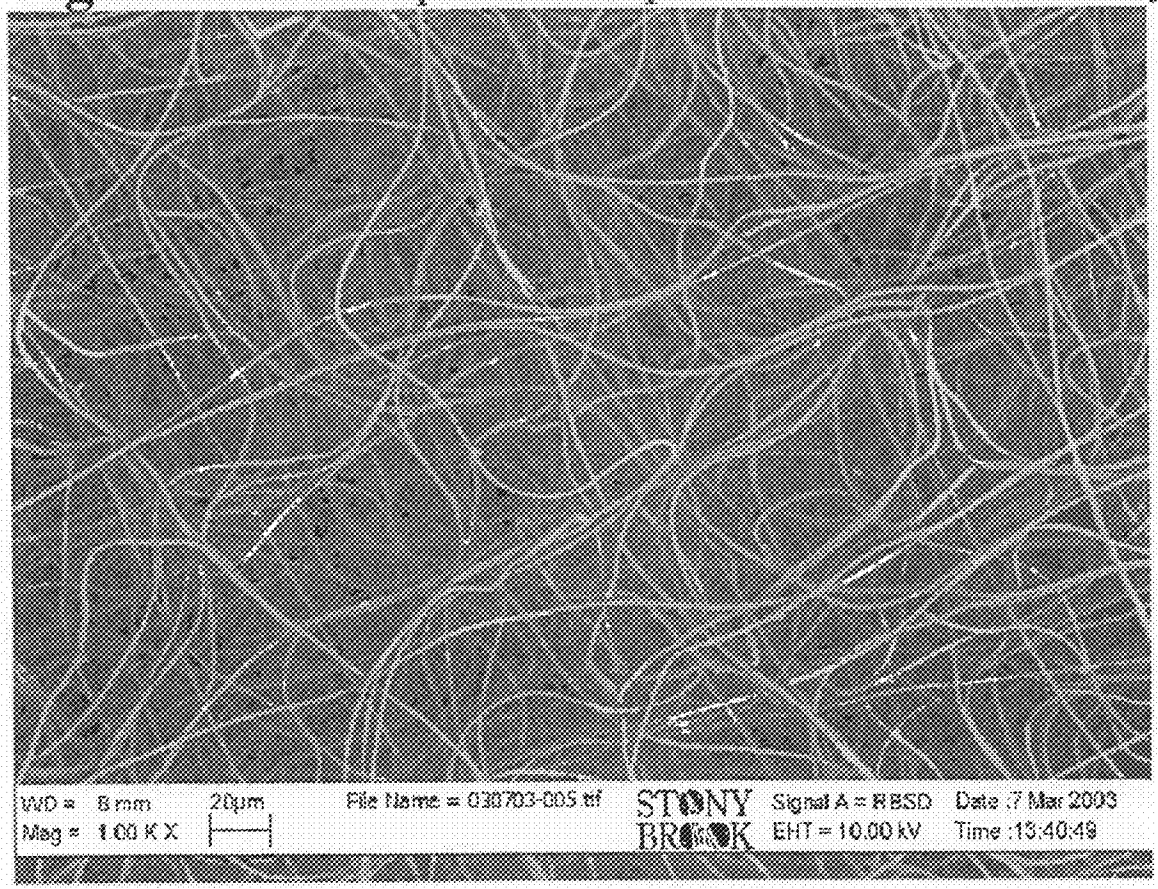
Figure 24. SEM picture of a post-annealed and biaxially drawn PLGA membrane

APPARATUS FOR ELECTRO-BLOWING OR BLOWING-ASSISTED ELECTRO-SPINNING TECHNOLOGY

CROSS REFERENCE TO RELATED APPLICATIONS

This application is a Divisional of U.S. patent application Ser. No. 10/936,568, filed Sep. 9, 2004, the entire contents of each of which are hereby incorporated by reference.

BACKGROUND OF THE INVENTION

1. Field of Invention

The present invention relates to electro-blowing or blowing-assisted electro-spinning technology, and more particularly to a spinneret format and to a process for post-treatment of membranes formed from such technology, including a cleaning method and apparatus for electro-blowing or blowing-assisted electro-spinning technology.

2. Discussion of the Background

One technique conventionally used to prepare fine polymer fibers is the method of electro-spinning. When an external electrostatic field is applied to a conducting fluid (e.g., a charged semi-dilute polymer solution or a charged polymer melt), a suspended conical droplet is formed, whereby the surface tension of the droplet is in equilibrium with the electric field. Electro-spinning occurs when the electrostatic field is strong enough to overcome the surface tension of the liquid. The liquid droplet then becomes unstable and a tiny jet is ejected from the surface of the spinneret tip. As it reaches a grounded target, the jet stream can be collected as an interconnected web of fine sub-micron size fibers. The resulting films from these non-woven nanoscale fibers (nanofibers) have very large surface area to volume ratios.

The electro-spinning technique was first developed by Zeleny[1] and patented by Formhals[2], among others. Much research has been done on how the jet is formed as a function of electrostatic field strength, fluid viscosity, and molecular weight of polymers in solution. In particular, the work of Taylor and others on electrically driven jets has laid the groundwork for electro-spinning[3]. Although potential applications of this technology have been widely mentioned, which include biological membranes (substrates for immobilized enzymes and catalyst systems), wound dressing materials, artificial blood vessels, aerosol filters, and clothing membranes for protection against environmental elements and battlefield threats[4-26]. The major technical barriers for manufacturing nanofibers by electro-spinning are the low speed of fabrication and the limitation of process to polymer solutions, which can be summarized as follows:

1. The first barrier involves electrical field interferences between adjacent electrodes (or spinning jets), which limit the minimum separation distance between the electrodes or the maximum density of spinnerets that can be constructed in the multiple jet electro-spinning die block. Recently, scientists at STAR (Stonybrook Technology and Applied Research) and at Stony Brook University developed a unique esJets™ technology and the new technology can overcome this hurdle (B. Chu, B. S. Hsiao and D. Fang, Apparatus and methods for electro-spinning polymeric fibers and membranes. U.S. Pat. No. 6,713,011 (2004)).

2. The second barrier is related to the low throughput of the individual spinneret. In other words, as the fiber size becomes very small, the yield of the electro-spinning process becomes very low.

3. The third barrier is limited by the capability for continuous operation over extended periods of time and automatic cleaning of multiple spinnerets with minimal labor involvement.

4. The last barrier of electro-spinning is due to the limitation of solution processing, where the use of solvent severely hinders the industrial applicability of the technique. The current invention is aimed to overcome (2)-(4) technical hurdles of the conventional electro-spinning technology, as well as to affect (1) the flow of fluid jet streams by gas-blowing.

U.S. patent application Ser. No. 10/674,464 (2003) (B. Chu, B. S. Hsiao, D. Fang, A. Okamato, Electro-Blowing Technology for Fabrication of Fibrous Articles and Its Applications of Hyaluronan) was filed by STAR based on the concept of blowing-assisted electro-spinning from polymer solutions and the preparation of hyaluronic acid (HA) nanofibers using this technology. The entire content of U.S. Ser. No. 10/674,464 is hereby incorporated by reference.

PCT application WO 03/080905 (2003), filed by scientists at NanoTechniques, proposes a high-throughput production method based partially on electro-spinning: A manufacturing device and the method of preparing for the nanofibers by electro-blown spinning process. However, there are several drawbacks in this disclosed technology.

1. It only deals with the processing of polymer solutions.

2. It does not fully utilize the electrical field to achieve a sufficiently large spin-draw ratio during blowing, thus, they cannot produce smaller size diameter fibers (e.g., fibers of less than 300 nm in diameter).

3. It cannot sustain a long-term operation capability (e.g., >5 days) because the unavoidable polymer deposits (accumulations) on the spinneret will pose a major problem for sustained operation. No scheme was proposed to resolve this difficulty.

3. General Consideration

Electro-spinning and melt-blowing are established technologies. In electro-spinning, the applied electric field is the main driving force responsible for the production of sub-micron diameter fibers; while in melt-blowing, the mechanical gas-flow shear/elongational and drag force is the main driving force responsible for the production of micron diameter fibers. The advantage of the electro-spinning process is the production capability of smaller sub-micron diameter fibers with sizes in the 10 nm-micron diameter size range, but the disadvantage has been the relatively lower production throughput. The advantage of the melt-blowing process is the relatively high-production throughput, while the disadvantage is the production of relatively larger fiber diameters in the micron diameter size range.

The combination of an applied electric field and a flowing gas stream is a natural extension of such technologies. However, the successful implementation of a combination of the two technologies is in making a distinction between spinning a polymer in the molten state (e.g., melt-blowing) or in the solution state (e.g., electro-spinning). In melt-blowing, the resistance to spin-draw of the polymer-melt jet stream is closely related to the anisotropic crystallization and solidification processes as well as the speed of the gas (air, in most cases) that provides the mechanical shear and drag force, whereas in electro-spinning of a polymer solution, the resistance to spin-draw a solution jet is closely related to the solvent evaporation rate, in addition to polymer solidification and possible crystallization.

It is clear that the jet instability due to electrical repulsion inside the jet stream is an essential means to produce the very large spin-draw ratio (in the absence of bifurcation), necessary for the production of truly sub-micron diameter fibers.

Then, the essence of a temperature-controlled gas-blowing assisted electro-spinning process is to use the gas, not only as a shear/elongational and drag force, but also to control the polymer solidification/crystallization from polymer melts as well as the rate of solvent evaporation, together with solidification from polymer solutions. In both processes that use a combination of electrical force and gas-blowing force, as well as in the established electro-spinning and melt-blowing technologies, sustained operations over long time periods have been a major drawback in practice. For example, even with the established melt-blowing technology, provisions are made to replace entire banks of a melt-blowing unit in order to be able to maintain continuous operation. For solution spinning, the solidified polymer around the spinneret is often below the polymer glass transition temperature. Such accumulations around the spinneret head cannot be routinely removed by blowing gas. Thus, solution spinning can impose a more serious problem. For the gas-blowing dominated spinning process, the spinneret diameter may have to be relatively smaller because of more limited spin-draw ratio.

It should be noted that spinning is a physical process. In electro-spinning, the spin-draw ratio is of the order of one million. Consequently, for a production rate of ~6 g of polymer/20 hrs/spinneret by using a 10 wt % polymer solution (assuming a density of 1 g/cm$^3$) and an effective cross-sectional area of 0.04 mm$^2$ for the spinneret hole, the initial fluid velocity is ~75 m/hr. With a spin-draw ratio of one million, a final fiber cross-sectional area of 0.04 μm$^2$ (corresponding to a fiber diameter of about 200 nm) and remembering that the polymer solution contains 90% solvent that will be evaporated, the final fiber speed reaching the collector is about 750 km/hr, about the speed of an airplane. Thus, if one considers increasing the production rate per jet by a factor of only 10, the fiber speed will break the sound barrier, long before the fiber cross-section can be reduced to much smaller than the cross-sectional area of 0.04 μm$^2$. This illustration simply implies that, for a single jet stream from each spinneret, i.e., without bifurcating the jet stream into multiple jet streams, the generation of very small fiber diameters cannot be accomplished only by using the mechanical gas shearing/elongational and drag force (as in melt-blowing). It has to be achieved with the additional electrical force. Furthermore, a gas-flow rate beyond the sound barrier is impractical, not to mention the high-energy consumption needed to produce a gaseous stream at very high velocities. Thus, there is a need for practical solutions to the above, by increasing the number of spinnerets with robust operations, and for smaller diameter fibers, the process is a gas-flow assisted electro-spinning process. It should also be noted that more effective operations require high polymer solution concentrations. Thus, a polymer melt, having no solvent to evaporate, is an effective way to increase the production rate, if the polymer melt viscosity can be reduced to the proper range. The limitation for melt-spinning using a combination of electrical and mechanical (gas-blowing) forces is related to high temperature operations and the nature of temperature control.

Methods for the post-treatment of electrospun (or electroblown) membranes are needed to provide new structures (crystallinity and crystal form), new morphologies (multiple distributions of porosity, preferred fiber orientation), and improved membrane properties (mechanically and thermally stable in dry and wet environments, electrical conductivity). The capability to manipulate the structure and morphology of electro-spun membranes using such post-treatments can provide means to control and enhance the physical properties for varying applications, such as improved thermal and mechanical stability and electrical conductivity for fuel cell and battery applications, controlled porosity distributions for cell attachment and proliferation in tissue engineering, and new separation capability for many applications such as filtration.

SUMMARY OF THE INVENTION

Accordingly, one object of the present invention is to provide a spinneret assembly for forming a polymer fiber, which is self-cleaning and provides higher throughput per spinneret, particularly for electrospinning or electroblowing of polymer melts.

A further object of the present invention is to provide a post-treatment orientation process for membranes formed from electrospinning or electroblowing processes.

These and other objects of the present invention have been satisfied by the discovery of a spinneret assembly configured to form a polymer fiber, comprising:

a spinneret body defining a retaining void configured to retain one of a polymer solution and a polymer melt and defining a delivery void configured to deliver the one of the polymer solution and the polymer melt from the spinneret body;

a discharge needle, that can be heated to above the polymer melt temperature, if needed during the cleaning process, disposed in the spinneret body, the discharge needle comprising an upper portion and a tip portion connected to the upper portion, the upper portion having a diameter about equal to a diameter of the delivery void, and the tip portion having a diameter less than the diameter of the upper portion, the upper portion configured to move between a first position disposed outside the delivery void and a second position disposed within the delivery void;

and the discovery of a method for orienting fibers of a fibrous membrane, comprising:

simultaneously drawing and annealing the fibrous membrane, either uniaxially or biaxially (where the biaxial drawing and annealing can be performed simultaneously in both directions or sequentially in each direction), at a strain ratio of from 5 to 1,000%, at a temperature greater than a glass transition temperature of a polymer forming the fibers of the fibrous membrane.

BRIEF DESCRIPTION OF THE FIGURES

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 22 shows the morphology of a typical electrospun membrane (e.g. Polyglycolide (PLGA) spun from 20% DMF solution under 25 kV electrical field).

FIG. 23 shows a representative morphology of the uniaxially drawn and annealed PLGA membrane.

FIG. 24 shows a representative morphology of the simultaneous biaxially drawn and annealed PLGA membrane.

DETAILED DESCRIPTION OF THE INVENTION

A detailed description of the present invention, including non-limiting examples of one or more preferred embodiments thereof, is now provided with reference to the drawings, wherein like reference numbers throughout the several views identify like and/or similar elements.

In the present invention, two different technologies have been developed to fabricate nanofibrous articles from either polymer melts or polymer solutions: (1) blowing-assisted electro-spinning, and (2) electro-blowing, all with self-cleaning features implemented. Both technologies comprise the use of two external forces (electric force and mechanical (gas-blowing shear/elongational drag) force) to achieve a very large spin-draw ratio during spinning. In the blowing-assisted electro-spinning process, the electric force is the dominating factor, while the gas-blowing feature can assist in shearing/dragging the fluid jet stream and in controlled evaporation of the solvent. The advantage of this process will be the consistent production of smaller fiber size (e.g., 100-500 nm in the fiber diameter) but the disadvantage will be the relatively lower production throughput. In contrast, the gas-blowing force in the electro-blowing process is the dominating factor to achieve the desired spin-draw ratio. The advantage of this process will be a relatively higher production throughput (at a level lower than that of melt blowing but to a similar order of magnitude), while the disadvantage will be the production of relatively larger fiber diameters (~0.5 μm).

Figure 1:
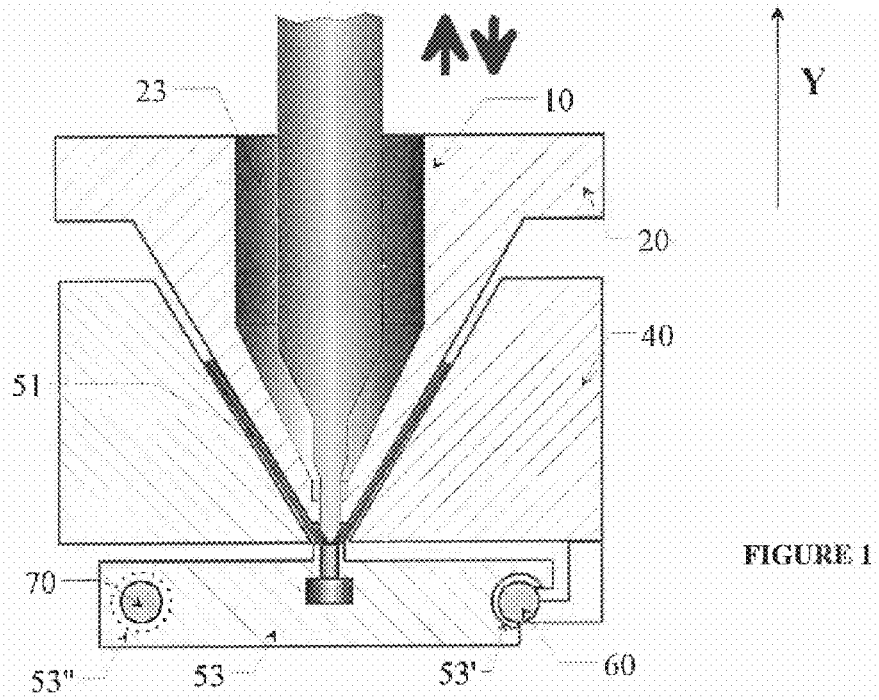
FIG. 1 shows a front cross-sectional view of an embodiment of the present invention spinneret.

The present invention relates to a single jet operation, as shown in FIG. 1, and can be summarized as follows:

1. Use of much larger apertures (~0.3-3 mm in diameter) for the spinneret aperture hole, as the cross-section is limited by the gap between the pin and the spinneret aperture hole.
2. Variation of the effective spinneret aperture (or orifice hole) in-situ, without changing the spinneret by using a tapered pin that can adjust the gap size between the spinneret aperture hole and the pin.
3. Adjustment of the fluid flow pathway to reduce fluid-flow fluctuations, because the position of the pin also controls the fluid channel size.
4. Self-cleaning of the enlarged spinneret channel, both in the narrow interior and immediately outside of the spinneret aperture hole.
5. Self-cleaning of the focusing electrode using solid pin (needle, that can be heated to above the polymer melt temperature, if needed during the cleaning process) in the tip region (diameter in the range of 0.10-2.96 mm)
6. Independent optimizations of electrode configuration and of gas-blowing geometry.
7. Control of the solvent evaporation rate, polymer solidification (including crystallization) along the material jet flight path for solution spinning or polymer solidification (including crystallization) for melt spinning.
8. The electrical field reversal design that can facilitate the assembly of spinneret/gas flow/secondary electrode/self-cleaning configuration.
9. Guided concentric needle that can introduce a second polymer melt/solution to form nanofibers of core-shell structure.

The present invention further relates to a multiple jet spinning operation as follows: A major embodiment lies in the development of a self-cleaning mechanism, where gas-flow and material jet pathways can be directed by a combination of mechanical baffles and secondary electrodes, including dual purpose controls, whereby the mechanical baffle is also secondary electrode. The innovative self-cleaning design has the following features:

a. It permits robust operation over extended periods of time for spinning operations using either polymer melt or polymer solution (due to above 1, 4 and 5), b. It can accommodate fluids over a wider viscosity range (due to above 1, 2, and 3), c. It can perform all four modes of operations: electro-spinning, melt-blowing, temperature-controlled gas-blowing assisted electro-spinning and electric-field assisted gas blowing technologies, without major modifications in the spinneret head (due to above 1-8)

d. It becomes especially suitable for multiple jet operation (due to above 1-8) and the use of secondary electrodes and baffles e. It allows the mechanical baffles to serve as primary electrodes, with the shape of the baffle tip that can be adjusted to optimize the electrical field distribution.

f. It can produce non-woven nanofibrous articles with core-shell structured nanofibers (due to above 9).

The present invention further relates to a process for simultaneous and/or sequential drawing (uniaxial and/or biaxial) and annealing, of membranes after their production by electrospinning or electroblowing.

Cleaning Mechanism for Use in Blowing-Assisted Electro-Spinning Process and Electro-Blowing Process During a blowing-assisted electro-spinning process and an electro-blowing process using a polymer solution, deposition of an at least partially solidified polymer on an internal and/or external surface of the spinneret can occur as a result of solvent evaporation. It is to be understood that the deposition of the at least partially solidified polymer can limit a useable operation run time, as the process can be halted during frequent maintenance and/or cleaning of the spinneret to remove the solidified polymer.

Figure 2:
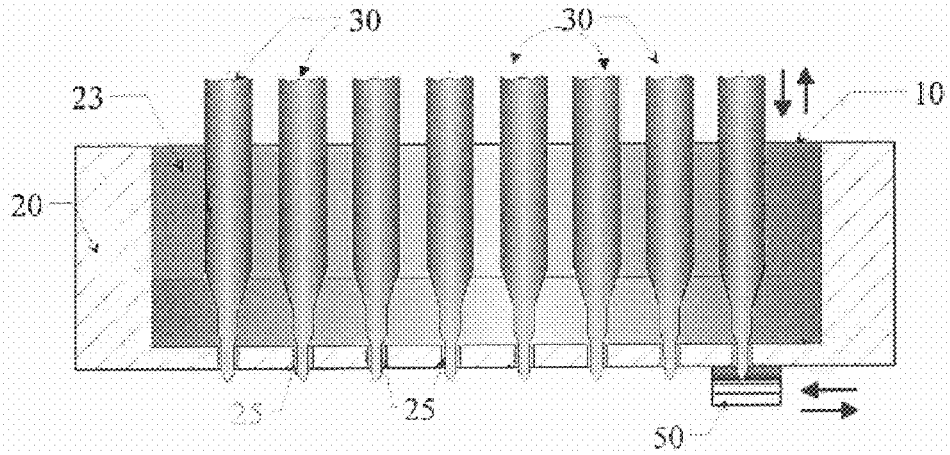
FIG. 2 shows a side cross-sectional view of the spinneret of FIG. 1.
Figure 4:
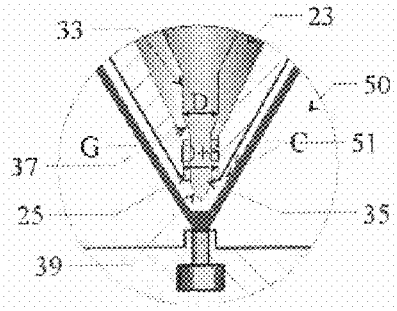
FIG. 4 shows a detail view of the spinneret of FIG. 1.
Figure 3:
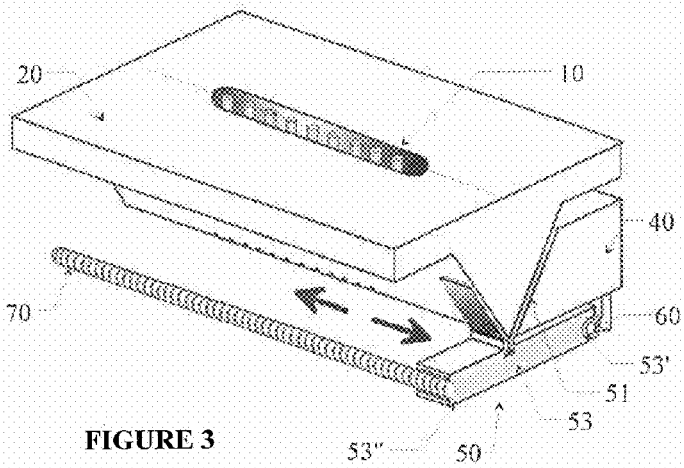
FIG. 3 shows an isometric view of the spinneret of FIG. 1.

FIGS. 1-4 show examples of a cleaning mechanism configured to remove the at least partially solidified polymer from the spinneret, in accordance with the present invention. FIG. 1 shows a front cross-sectional view of the spinneret. FIG. 2 shows a side cross-sectional view of the spinneret of FIG. 1. FIG. 3 shows an isometric view of the spinneret of FIG. 1. FIG. 4 shows a detail view of the spinneret of FIG. 1.

As shown in the figures, the cleaning mechanism 50 can be configured to remove the at least partially solidified polymer from one or both of the internal and/or external surfaces of the spinneret 10. The spinneret 10 can include a spinneret body 20 defining a retaining void 23 configured to retain one of a polymer solution and a polymer melt. The spinneret body can define a delivery void 25 configured to deliver the one of the polymer solution and the polymer melt from the spinneret body 20. The delivery void 25 can have an at least about cylindrical shape. Although the drawings show preferred embodiments of the spinneret body 20, it is to be understood that the spinneret body 20 can be of various types, including known types, as long as the spinneret body 20 can deliver the one of the polymer solution and the polymer melt disposed therein At least one discharge needle 30, that can be heated to above the polymer melt temperature, if needed during the cleaning process, can be used to remove the at least partially solidified polymer from the internal surface of the spinneret 10. As shown in the figures, the discharge needle 30 can be movably disposed in the retaining void 23 of the spinneret body 20, such that the one of the polymer solution and the polymer melt retained in the retaining void 23 can contact and flow around the discharge needle 30. The discharge needle 30 can include an upper portion 33 having a diameter about equal to a diameter of the delivery void 25. By this arrangement, the upper portion 33 of the discharge needle 30 can be configured to move in a vertical direction (i.e., along the Y-axis, as shown in the drawings) between a first position disposed outside the delivery void 25 and a second position disposed within the delivery void 25. It is to be understood that the upper portion 33 of the discharge needle 30 can be configured to clean the delivery void 25 by movement between the first and second positions, and more specifically can be configured to remove the at least partially solidified polymer from the delivery void 25 by urging the solidified polymer from the delivery void 25 by movement between the first and second positions.

The upper portion 33 of the needle 30 can have a cylindrical shape, and can correspond to the shape of the delivery void 25. The diameter of the upper portion 33 of the discharge needle 30 can be slightly less than the diameter of the delivery void 25, such that the upper portion 33 does not bind during movement between the first and second positions. In a preferred embodiment of the invention, the diameter of the delivery void 25 can be from 0.3 mm to 3.0 mm, and a diameter of the upper portion 33 of the discharge needle 30 can be from 0.10 mm to 2.96 mm.

The discharge needle 30 can include a tip portion 35 connected to the upper portion 33. The tip portion 35 can have a diameter less than the diameter of the upper portion 33.

The discharge needle 30 can include a transition portion 37 disposed between the upper portion 33 and the tip portion 35. The transition portion 37 can have a conical shape including first and second diameters corresponding to the diameters of the upper and tip portions 33, 35.

The discharge needle can include an ultimate or free end portion 39 disposed adjacent the tip portion 35 and apart or away from the upper and transition portions 33, 37. The ultimate portion 39 can have a conical shape, and can be connected to the tip portion 35.

In a preferred embodiment of the invention, the discharge needle 30 has a solid (non-hollow cross section), and includes a metal, such as stainless steel.

The spinneret 10 can include an air inlet block or air path body 40 disposed apart from the spinneret body 10 to define a gap there-between, the gap configured to receive a compressed gas (e.g., air) and/or to guide the gas to a position adjacent the delivery void. Although the drawings show preferred embodiments of the path body 40 it is to be understood that the path body 40 can be of various types, including known types, as long as the path body 40 can receive gas and/or guide gas to a position adjacent the delivery void 25.

The discharge needle 30 can have a predetermined geometry configured to provide one or more further advantages, in addition to or in place of removing the at least partially solidified polymer from the interior surface of the spinneret 10. Examples of further advantages can include, but are not limited to, regulating one or more of a flow rate and a liquid profile in an initial stage of the jet formation during the blowing-assisted electro-spinning and electro-blowing process, and controlling with a predetermined geometry of a portion (e.g., a tip portion) of one or more of the discharge needles an electrical field distribution to facilitate the blowing-assisted electro-spinning and electro-blowing process.

The flow rate and the liquid profile in the initial stage of the jet formation during the blowing-assisted electro-spinning and electro-blowing process can be further regulated by the placement position of the discharge needle in the delivery void, which can be controlled externally by a mechanical translational stage connected to the discharge needle.

Although not illustrated in the figures, the spinneret assembly can include one or more banks of discharge needles, each of the banks including one or more discharge needles. By this arrangement, the cleaning mechanism can be applied to a high throughput commercial application of the blowing-assisted electro-spinning process and the electro-blowing process.

The cleaning unit 50, that can be heated to above the polymer melt temperature, if needed during the cleaning process, can be used to remove the at least partially solidified polymer from the external surface of the spinneret 10. As shown in the figures, the cleaning unit 50 can be disposed outside of the spinneret body 20. The cleaning unit can be configured to move adjacent an exterior surface of the spinneret body 20 and to remove the at least partially solidified polymer from the exterior surface of the spinneret body 20.

As shown in the drawings, the cleaning unit 50 can include a cleaning surface having a shape corresponding to a shape of the exterior surface of the spinneret body 20. The cleaning unit 50 can include a first portion 51 having a shape corresponding to the shape of the exterior surface of the spinneret body 20, such as a V-shaped cross-section corresponding to a V-shaped portion of the exterior surface of the spinneret body 20. The first portion 51 of the cleaning unit 50 can be disposed apart from the exterior surface of the spinneret body 20 to define a gap there-between, and can be disposed within the gap between the spinneret body 20 and the path body 40.

The cleaning unit 50 can include a second portion 53 having a predetermined geometry configured to slide along a guide rail 60 (such as on a first end 53' of the second portion 53), and/or a predetermined geometry configured to move as a result of rotation of a threaded member 70 (such as on a second end 53" of the second portion 53 opposite the first end 53'). Although not shown in the drawings, the cleaning unit 50 can include one or more cleaning voids configured to receive the tip portions of the one or more discharge needles. By this arrangement, the cleaning void can be configured to remove the at least partially solidified polymer from the discharge needle 30.

In a preferred embodiment of the invention, the cleaning unit 50 can include a non-metal material, and more preferably can include a ceramic material.

The guide rail 60 can be disposed to extend parallel to, and can be connected to, the path body 40. As stated above, the second portion 53 of the cleaning unit 50 can be configured to slide on the guide rail 60 (for example, through a void defined in the second portion 53 of the cleaning unit 50, the void having a cross-sectional shape corresponding to a cross-sectional shape of the guide rail 60). The threaded member 70, such as a threaded rod, bolt, or screw, can be disposed to extend parallel to guide rail 60 and/or the path body 40. As stated above, the second portion 53 of the cleaning unit 50 includes a threaded portion configured to threadingly connect and cooperate with the threaded member 70. By this arrangement, rotation of the threaded member 70 can result in a linear movement of the cleaning member 50.

Option of Electrical Field Reversal for Multiple-Jet Blowing-Assisted Electro-Spinning and Electro-Blowing Process In a conventional electro-spinning process and a conventional electro-blowing process, an electric filed is provided between the spinneret and the collection target. Specifically, the spinneret is maintained at a high voltage, and the collection target is maintained at a ground potential. Although relatively smaller scale components of the process, which are generally used in a laboratory environment, can be maintained at the high voltage, it is difficult to maintain at the high voltage relatively larger scale components used in a high throughput commercial application of the process.

Figure 5:
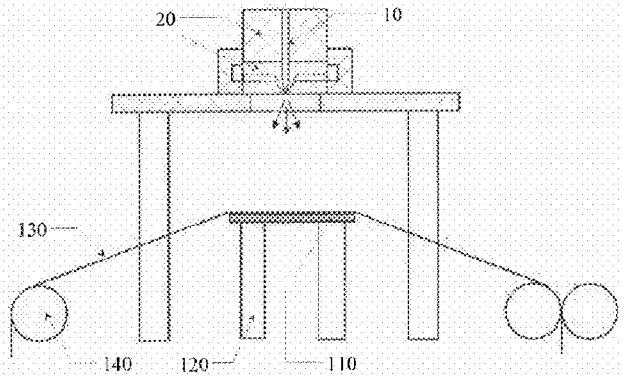
FIG. 5 shows a front elevation view of an embodiment of the present invention process.
Figure 6:
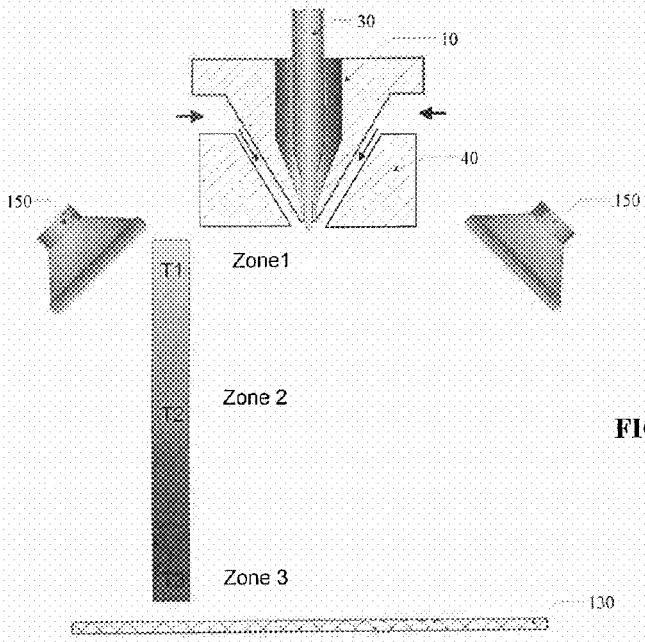
FIG. 6 shows a detail view of the process including heating lamps, according to an embodiment of the invention.
Figure 7:
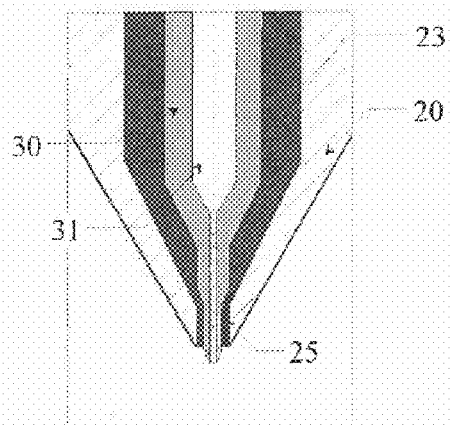
FIG. 7 shows a detail view of a needle, according to an embodiment of the invention.
Figure 8:
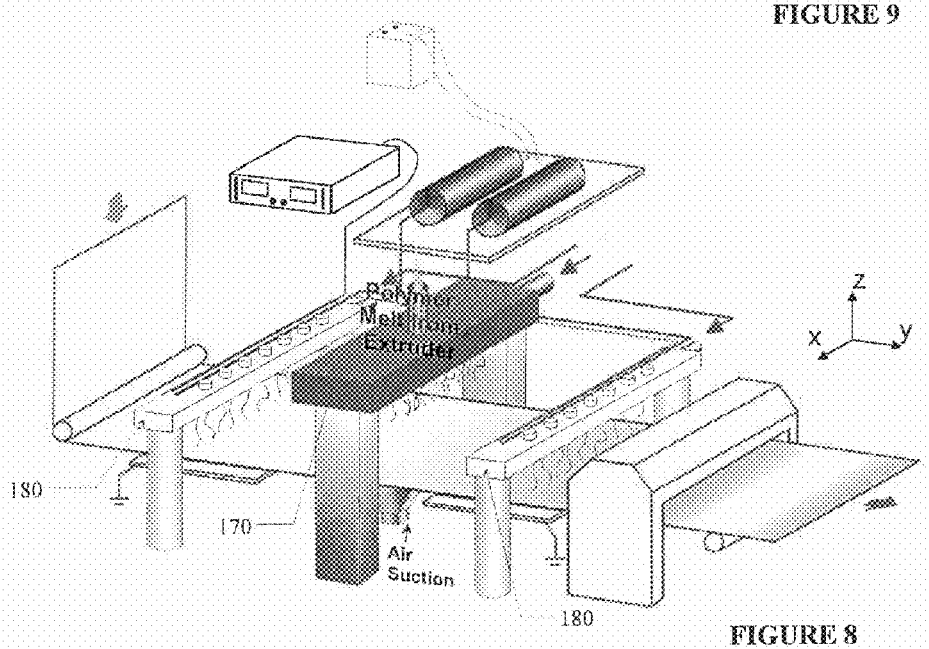
FIG. 8 shows an isometric view of the process, according to an embodiment of the invention.

FIGS. 5-8 show examples of using electrical field reversal optional configuration for a multiple-jet blowing-assisted electro-spinning and electro-blowing process. FIG. 5 shows a front elevation view of the process. FIG. 6 shows a detail view of the process including heating lamps, according to an embodiment of the invention. FIG. 7 shows a detail view of a needle, according to an embodiment of the invention. FIG. 8 shows an isometric view of the process, according to an embodiment of the invention.

As shown in the figures, an electrical field reversal is maintained in the electro-spinning process and the electro-blowing process. Specifically, the spinneret 10 can be maintained at or near a ground potential, and the collector or target 110 can be maintained at a high voltage. By this arrangement, large scale components of the process, such as a heater, a compressor, and the like, can be maintained at or near the ground potential, and are not required to be maintained at the high voltage.

As shown in the figures, the apparatus configured to form a polymer fiber can include one or more of the components discussed above, including the spinneret assembly 10. A ground potential source can be connected to these components of the apparatus, including the spinneret 10, and can be configured to maintain these components, including the spinneret 10, at or near the ground potential.

The target 110 can be configured to receive the one of the polymer solution and the polymer melt from the spinneret 10. In a preferred embodiment of the invention, the target 110 can include a relatively smooth plate, and can include a conducting metal.

A voltage source can be connected to the target 110 and can be configured to maintain the target 110 at a voltage above the voltage at which the spinneret 10 is held, and more specifically can be configured to maintain the target 110 at the high voltage. In a preferred embodiment of the invention, the plate can be maintained at a voltage of 35 kV.

In order to establish a stronger electric field than would otherwise be established, a distance between the spinneret tip and the target can be less than a typical distance in the conventional process (e.g., the distance can be 20 cm).

The target 110 can be support by at least one column 120 configured to electrically isolate the target 110. In a preferred embodiment of the invention, the target 110 can be support by a plurality of columns 120 configured to isolate the target 110 from components of the process, including the spinneret assembly 10.

A conveyor belt 130 of a non-conducting sheet can be disposed on the target 110 and can be configured to receive the one of the polymer solution and the polymer melt from the spinneret 10. As the conveyor belt 130 moves, the excess charge accumulated on the belt 130 can be removed by a connection to the ground. As shown in the drawings, the conveyor belt 130 can be in the form of an endless belt. In a preferred embodiment of the invention, the conveyor belt 130 can be manufactured from a material having a good electrical insulation, such as but not limited to a non-woven polypropylene cloth.

At least one grounding unit 140 can be configured to contact the conveyor belt 130 to remove a charge, such as an undesired built up charge, from the conveyor belt 130. The grounding unit 140 can include one or more rollers, the one or more rollers connected to a ground potential source configured to maintain the rollers at or near ground potential.

The conveyor belt 130 is preferably made of materials that have both good electrical insulation properties and mechanical properties. The electrical insulation should be able to withstand an electric field higher than 5 kV/cm in the direction of conveyor belt 130 transportation. The mechanical properties include good tensile strength, flexibility and as well as thermal stability. Suitable materials for convey belt 130 can include, but are not limited to, polypropylene and nylon, etc.

Electro-Blowing Process for Polymer Melt

To avoid issues related to use of the solvent in the polymer solution, such as issues related to pollution, the present invention can provide the electro-blowing process for a polymer melt that does not include the solvent. It is to be understood, however, that the described process is not limited to the polymer melt, and can be applied to the polymer solution including the solvent.

It is to be understood that in melt spinning in the electro-blowing process, the polymer is initially maintained above its melting temperature. The polymer melt is maintained in the molten state as a viscous liquid, with the viscosity being dependent on the temperature of the polymer melt. Thus, it is to be further understood that deposition on the spinneret of an at least partially solidified polymer can be partially prevented by blowing a hot gas (e.g., hot air) at a high velocity. In solution spinning in the electro-blowing process, the polymer is initially maintained in a solution including the solvent. After evaporation of the solvent from the solution, the polymer solidifies. Thus, the blowing of the hot gas generally cannot completely prevent deposition of the solidified polymer on the spinneret.

In the process, it is generally desirable to maintain the polymer melt in the molten state after leaving the spinneret, such that an electric pulling force provided by the process can overcome a viscoelastic property of the polymer, and a relatively very large stretch-drawn ratio can be provided to the polymer during the fiber formation. As shown in the figures, a high temperature environment can be provided during the process.

As shown in the figures, the apparatus can provide a temperature gradient zone. The apparatus can include at least one heating lamp 150 to provide the zone, such that a majority of an instability zone can be above the solidification/crystallization temperature of the polymer. The temperature gradient zone can include zones 1, 2, and 3. A temperature in the zone 2 can be at least slightly lower than a temperature in the zone 1. A temperature in the zone 3 can be lower than a temperature in both the zones 1 and 2, to thereby permit the fiber to possibly crystallize partially. By this arrangement, when the fiber reaches the collector, the polymer nanofiber can be cooled down and solidified into a stable shape.

A potential interference between the heating lamp 150 and the electric field distribution can be avoided by electrically isolating, and sealing in an enclosure connected to the high voltage, the heating lamp 150. By this arrangement, the enclosure can serve as a secondary electrode.

The process according to the present invention can remain the same whether used for a single fiber output or jet or a plurality of jets (e.g., 100 or more jets). Thus, the process can be cost-effective for application to modules including a plurality of banks, each of the banks including a plurality of jets (e.g., 50-500 jets) used in a high throughput commercial application of the process.

Blowing-Assisted Electro-Spinning Process and Electro-Blowing Process for Fiber with Core-Shell Structure The present invention further provides fibers having a core and shell structure. As shown in the figures, the discharge needle 30 can include a hollow interior portion 31 configured to receive one of a second polymer melt and polymer solution. It is to be understood that the embodiment of the discharge needle 30 can provide a fiber including different polymer properties between the core and the shell, and can provide a shell fiber having a hollow core. Advantages that can be obtained with such a fiber can include, but are not limited to, the following.

The core-shell components can include fluids, polymers or copolymers (random and block) with incompatible, partially compatible, or compatible properties between the core and shell components. The final core-shell structure can depend on one or more of a mixing time, a spinning temperature, and a deformation rate.

The core components can be of fluids, lower molecular weight oligomers or polymers, protected by higher molecular weight polymer shell, in which the core component can be post-crosslinked to form an elastic center;

the core component can contain bioactive agents (e.g. drugs, medicine and DNAs) together with micelles, for controlled delivery;

the core component can contain nanofillers (nanospheres, nanotubes, nanofibers) with enhanced mechanical or electrical properties, as well as an ability to act as carriers of bioactive agents and/or other reagents; and/or the core component can contain biodegradable polymers.

The shell components can be of lower molecular weight oligomers or polymers, supported by the higher molecular weight polymer core, in which the shell component can be post-crosslinked to form an elastic, porous, and/or protective layer;

the shell component can contain bioactive agents (e.g. drugs, medicine and DNAs) for controlled delivery;

the shell component can contain nanofillers (nanospheres, nanotubes, nanofibers) with enhanced mechanical or electrical properties, as well as an ability to act as carriers of bioactive agents and other reagents;

the shell component can contain biodegradable, biocompatible, or bioabsorbable polymers; and/or the shell component can contain charged, hydrophilic or hydrophobic polymers.

Further, a shape of the discharge needle serving as a primary electrode can be used to control an electric field distribution around the spinneret.

Hybrid Technology of Multiple-Jet Blowing-Assisted Electro-Spinning or Electro-Blowing with Melt Blowing One or more of the above processes can be combined with a melt-blowing process, such as in a sequential fashion. As shown in the figures, a multiple-jet blowing-assisted electro-spinning/electro-blowing process can be combined with the melt-blowing process. As shown in the figures, a melt blowing unit 170 can be disposed at a center position, where a plurality (e.g., two or more) of banks of multiple-jet blowing-assisted electro-spinning/electro-blowing assemblies 180 are positioned at each side with a relatively short spinneret-to-collector distance. By this arrangement, a zone of instability of the jet can merge with primary high-velocity air from the melt-blowing process, to allow charged fibers to be further extended and/or to entangle with fibers produced by the melt-blowing process. Additional air streams can also be applied down stream of the spin line to enhance fiber mixing and to facilitate fiber collection. The combined effects of electrostatic repulsion and the high velocity of the air stream can provide a new type of nanofiber morphology.

The technology of electro-spinning has been applied to generate new membrane materials for many different applications, such as medical devices (anti-adhesion barriers and drug release carriers); tissue engineering scaffolds, membranes for filtration and separation, battery separator and catalyst substrates. The membranes resulted from the electro-spinning (or electro-blowing) process are random interconnected webs of sub-micron size fibers (typically 250 nm or less). Due to their large surface area to volume ratios and retarded crystallization rate during processing, the as-spun membranes sometimes suffer shrinkage and mechanical instability during applications. The present invention provides a process for post treatment of these membranes to improve the electro-spun properties and to generate new membrane structure. This preferred embodiment of the present invention is a process comprising simultaneous or sequential drawing (uni-axial and biaxial) and annealing, of membranes after electro-spinning or electroblowing.

The membranes can be formed from any polymeric material suitable for electrospinning or electroblowing. Preferred materials of interest are bioabsorbable and biodegradable linear aliphatic polyesters, including, but not limited to polyglycolides (PGA), poly(D,L)-lactides and their copolymers for biomedical applications.

The post-treatment process comprises annealing an electro-spun or electro-blown membrane under tension. The annealing is performed at a temperature preferably above the glass transition temperature of the material from which the membrane is made, more preferably 2-10° C. above the Tg of the material, most preferably about 5° C. above the Tg of the material. The annealing is preferably performed on the membrane after the membrane has been thoroughly dried to remove solvent from the electrospinning/electroblowing process (of course, if a polymer melt was used for the formation of the membrane, the drying step may be omitted).

The membrane is then drawn, either uniaxially or biaxially. In the biaxial case, the drawing can be simultaneously or sequentially in both directions. The drawing process provides improved crystallinity and orientation of the nanofibers.

The chosen applied strain for the drawing process (in either or both directions) ranges from 20% to 1,000%, preferably from 50% to 300%, more preferably from 80% to 150%. Of course, the applied strain is also dependent upon the material used to form the membrane, since some materials can be drawn more than others. The maximum applied strain for a particular material may be determined readily by those of skill in the art as the maximum drawing force needed to induce failure of the membrane in the desired direction.

The drawing process is preferably performed at a temperature ranging from room temperature (approximately 25° C.) to 120° C. All treatment parameters can be fine-tuned based upon the material used in the membrane, in order to control the desired structure and morphology, as well as the physical properties of the nanofiber membrane.

The drawing process itself can be performed using conventional fiber drawing apparatus, such as an Instron-type equipment.

The resulting drawn membranes can exhibit a different mean value of porosity and distribution, as well as fiber orientation. Additionally, the physical strength and mechanical stability of the treated membrane can be likewise significantly increased using the uniaxial or biaxial drawing process.

EXAMPLES

Having generally described the invention, further understanding can be obtained by reference to certain specific examples, which are provided herein for purposes of illustration only and are not intended to be limiting unless otherwise specified.

Instrumentation Development

Figure 9:
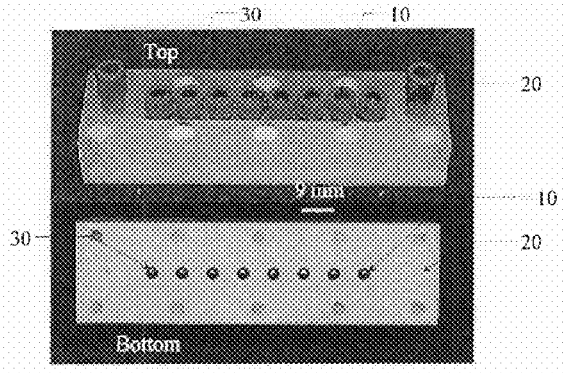
FIG. 9 shows a representation of a preferred embodiment of the present invention.

Two prototypes of multiple jet electro-blowing apparatuses were constructed in accordance with the present invention. The first prototype device involved the use of the patented esJets™ technology with secondary electrodes to shield each primary electrode during multiple jet electro-spinning for polymer solutions. Since the presence of secondary electrodes can weaken the field strength at the electrode tip, the geometrical shape, the location and the electric potential of the secondary electrodes, were optimized by finite element analysis simulations. The following two criteria were met simultaneously in the design: (1) each electrode in the multi jet system essentially had the same electric field distribution, and (2) an electric field strength on the electrode tip in the multi jet system was about the same as that in the single jet system. FIG. 9 shows a representation of the device. In the device, the spinneret packing distance was 9 mm. Each spinneret 10 included an independent solution/melt discharge needle 30 (solid), made of stainless steel or an inert and electrically conducting alloy.

The second prototype device included a spinning assembly with varying density of spinnerets (e.g., 5 spinnerets/inch and 25 spinnerets/inch—the same as that of a conventional melt-blowing device) without secondary electrodes. This device can be used to process both polymer melts and polymer solutions. A voltage as high as 50 kV can be applied. The throughput from the device can approach a production rate of a conventional melt blowing process. The design and the performance evaluation of this prototype multiple jet electro-blowing device is described as follows.

Figure 10:
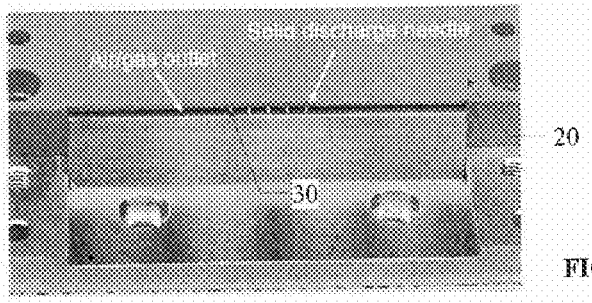
FIG. 10 shows the spinneret block 20 used in a prototype multiple jet electro-blowing system.

FIG. 10 shows the spinneret block 20 used in the prototype multiple jet electro-blowing system. The spinneret block 20 was made of high-strength steel (or an inert and conducting alloy (to aid in electrical conduction). The discharge needle 30 (solid) was also made of stainless steel, which served as the primary electrode and was used to regulate the polymer flow rate. The spinnerets 10 were positioned at the tip of a 60° slope with a linear density of 5 spinnerets/inch in the multiple jet spinneret block. The shape of the tip was designed to ensure the proper electrical field distribution for electro-spinning. The diameter of each spinneret hole was about 0.35 mm. The spinneret block 20 and an air knife were assembled in an enclosure so that the air can be uniformly blown out of a slit, and only a tip of the spinneret, which was made of conducting material, was exposed to the target (ground).

Figure 11A:
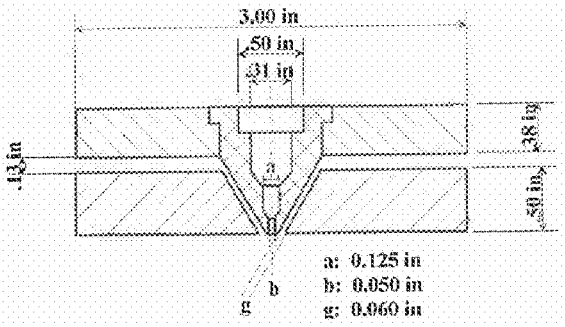
FIGS. 11*a* and 11*b* show the dimension of the prototype device and the details of an embodiment of the pin-spinneret configuration, respectively.
Figure 11B:
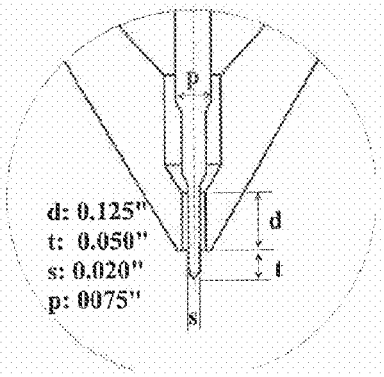

The compressed air was introduced from a side of the spinneret block. The air inlet block can be made of high performance PEEK or ceramic materials (for electrical insulation), whose mechanical strength can be maintained at temperatures higher than 250° C. Therefore, heated airflow at fairly high temperatures can be utilized. The air gaps were 1.5 mm and adjustable to change a shear force of the compressed air. The polymer melt was introduced into the spinneret assembly 10 by an extruder, while for polymer solution, the fluid can be introduced into the inlet by using a constant flow (or constant pressure) pump. The length of the slits formed by the air knifes was 4 inches. For fabrication of the multiple-hole spinneret assembly 10, three configurations were constructed and tested: one with 25 holes (per inch), one with 50 holes (over a 2-inch distance), and one as shown in FIG. 10 (with 5 spinnerets per inch but together with the pins). FIG. 11*a* shows the dimension of the prototype device and FIG. 11*b* shows the details of the pin-spinneret configuration.

Figure 12A:
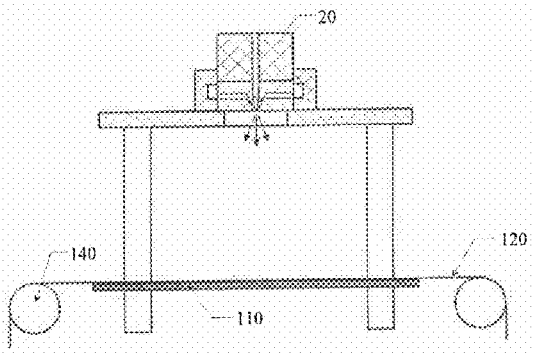
FIGS. 12*a* and 12*b* show a schematic diagram and photograph of this device during electro-spinning of a polymer solution.
Figure 12B:
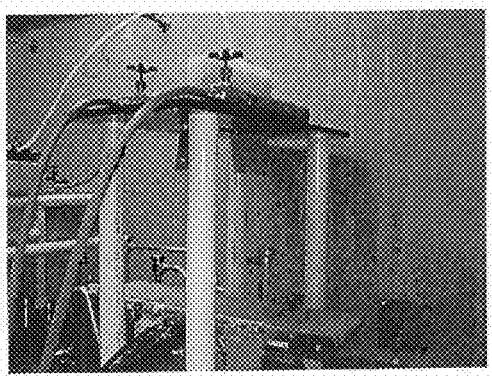

The assembled device was placed on an isolated platform. The schematic diagram and photograph of this device during electro-spinning of polymer solutions are shown in FIG. 12. The prototype platform could withstand a high voltage up to 50 kV. The conveyor belt 130 was made of polyester mesh and driven by a speed-tunable motor. There was an air-sucking duct under the conveyor belt 130 to remove the excess airflow from the blowing device. The polymer solution was pumped into the device by a large diameter (e.g., 26.6 mm) syringe pump with a variable computer-controlled flow rate. The distance R between the spinnerets tip and the grounding target 110 could also be adjusted. In our test, we set R=40 cm.

Example of Blowing-Assisted Electro-Spinning (Single Jet)

Thermopolyurethane (TPU)

Thermopolyurethane (TPU) is a breathable polymer, which has a wide application in moisture absorbable clothing and materials. To electro-spin TPU, a high stretching force is used in the fiber pulling/formation process.

Figure 13A:
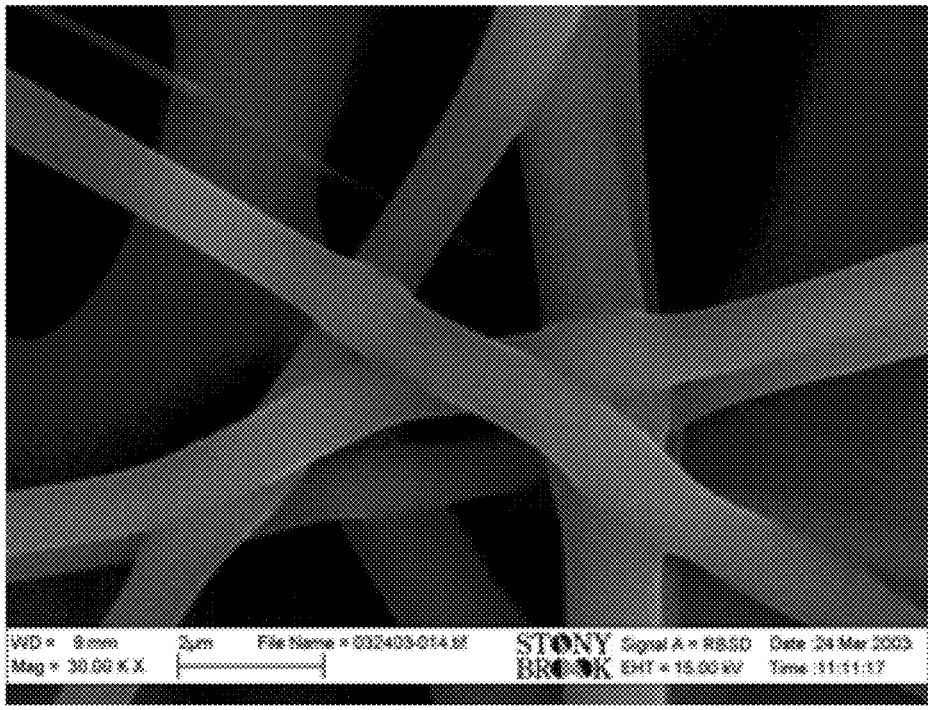
FIGS. 13*a* and 13*b* show SEM images of an electro-spun TPU membrane at two different magnification scales.
Figure 13B:
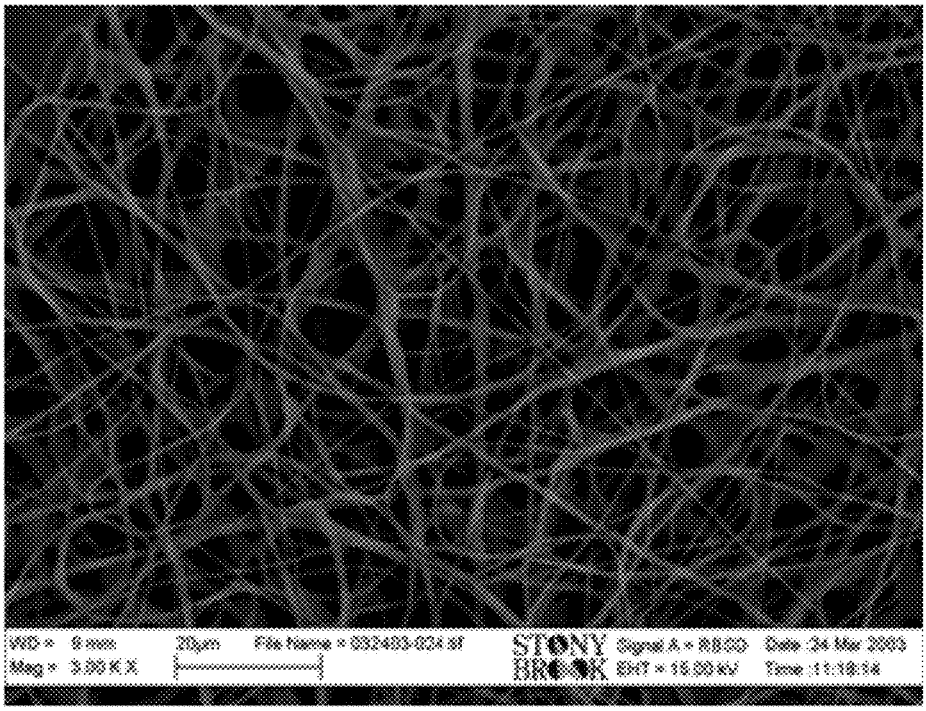

In this example, a commercial TPU (Estane 58245 from Noveon, Inc.) was used for the blowing-assisted electro-spinning. FIGS. 13*a* and 13*b* show SEM images of an electro-spun TPU membrane at two different magnification scales. This membrane was fabricated from 10 wt % TPU (Estane 58245) solution of DMF/THF (6/4) mixed solvent at 30.5 kV over a 15-cm distance between the spinneret and the collector. The airflow rate was 50 standard cubic feet per hour (SCFH) and the temperatures was 40° C. The solution flow rate was 40 μl/min. The average fiber diameter in the membrane was about 750 nm.

Polyacrylonitrile (Pan)

Figure 14A:
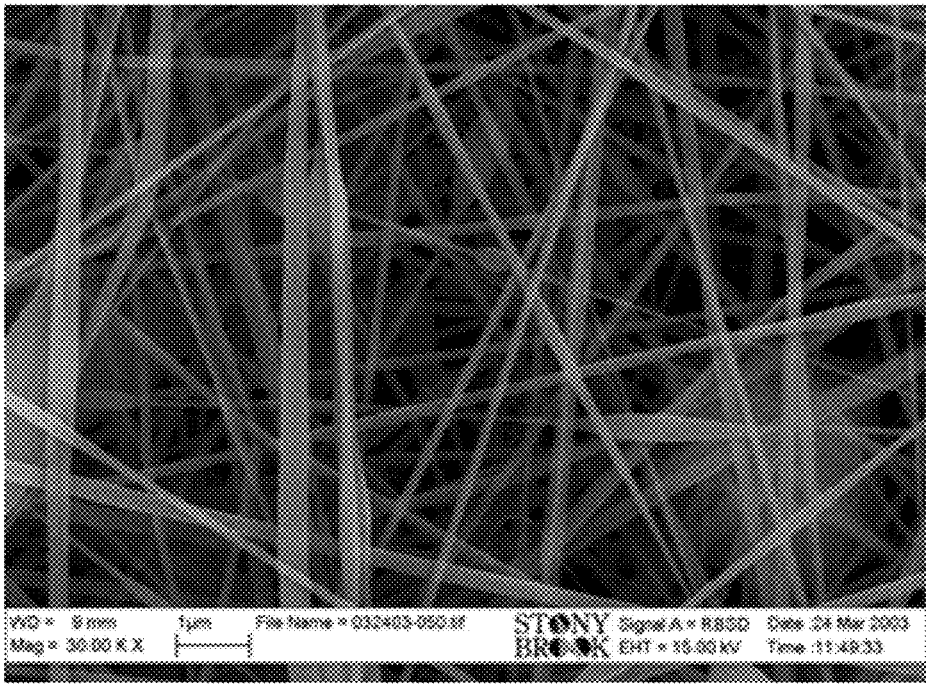
FIGS. 14*a* and 14*b* show morphology of electron-spun 7% wt PAN/DMF solution with airflow temperatures of 41° C. and 32° C., respectively.
Figure 14B:
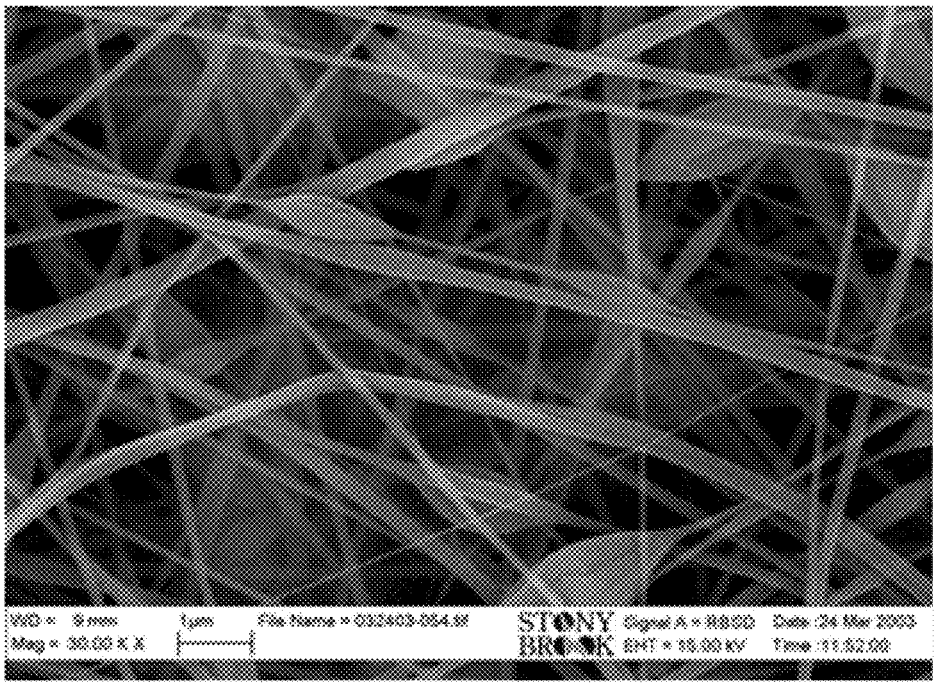

For polyacrylonitrile (pan), blowing-assisted electro-spinning was performed under different operating conditions. FIGS. 14*a* and 14*b* show morphology of electron-spun 7% wt PAN/DMF solution with airflow temperatures of 41° C. and 32° C., respectively. The airflow rate was 65 SCFH for both cases. The other conditions included a solution flow rate of from 40 to 45 μl/min, and a voltage from 26.5 to 27.5 kV over 15 cm. The average fiber diameter at higher air flow temperature was about 300 nm. The fiber diameter at lower air temperature did not increase greatly (to about 400 nm), although the fibers showed some beads-string structure.

Examples of Electro-Blowing (Multiple Jets)

Electro-Blowing of Polyethylene Oxide (PEO)

Figure 15A:
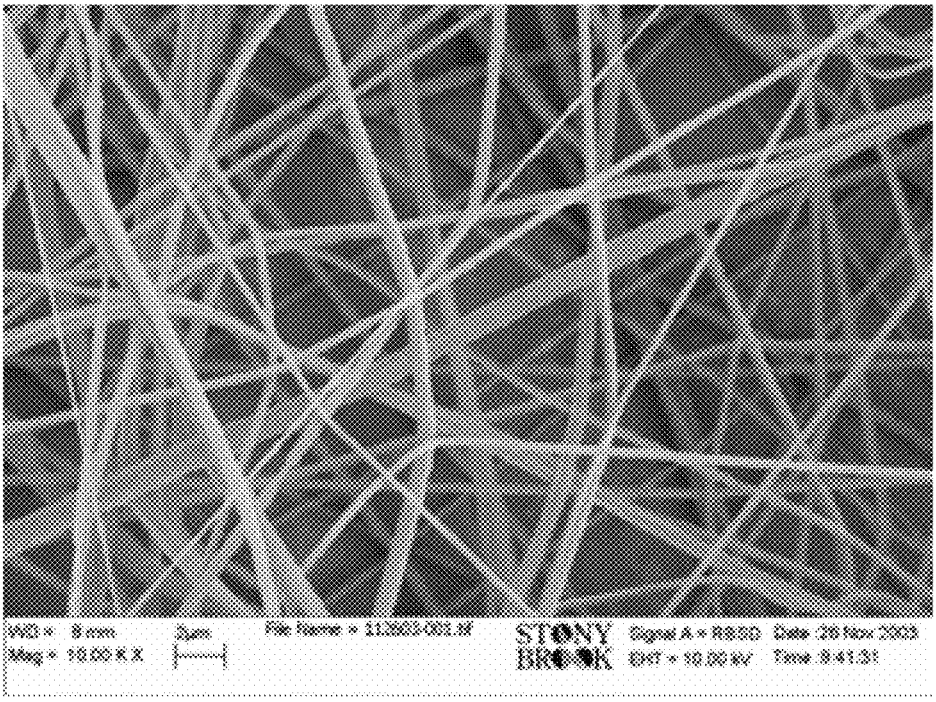
FIGS. 15*a* and 15*b* show SEM images of nanofibers formed from 5% PEO (molecular weight ~1.1 M) by using the high throughput electro-blowing apparatus (the distance between spinneret and ground was 40 cm).
Figure 15B:
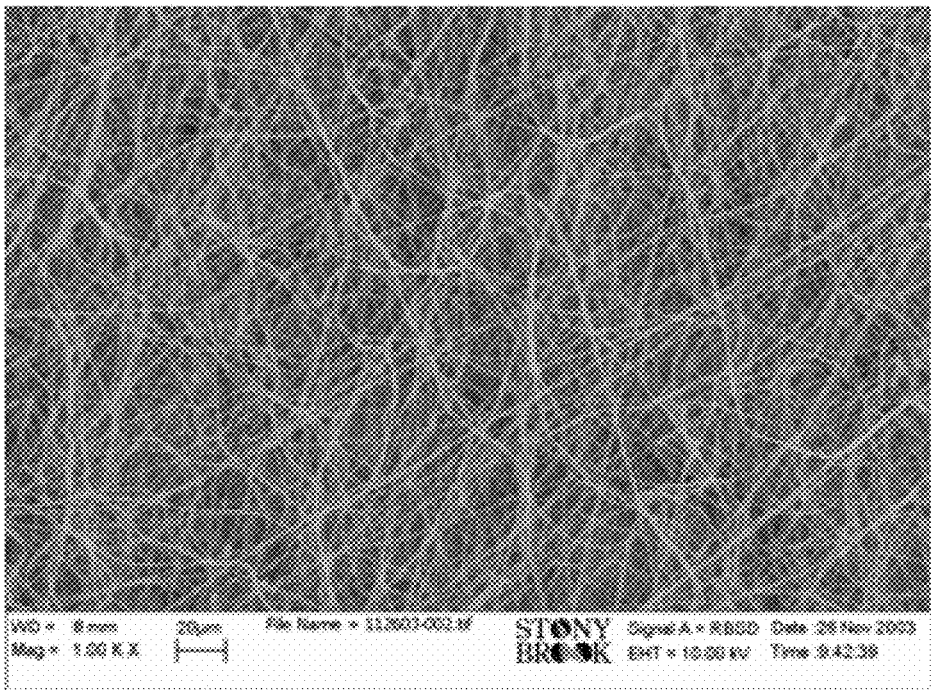

Two PEO solutions (in water) with different molecular weights of PEO (~1.1 M and 2.0 M) at different concentrations (5% and 2.2%) using the electro-blowing prototype devices were tested. The two chosen solutions had about the same viscosity (~760 centi-poise). FIGS. 15*a* and 15*b* show SEM images of nanofibers formed from 5% PEO (molecular weight ~1.1 M) by using the high throughput electro-blowing apparatus (the distance between spinneret and ground was 40 cm). The operating conditions included 25 kV, and 1.5 ml/min/50-spinnerets. The average air pressure was 50 psi and the air flow rate was 250-300 standard cubic feet per minute (SUM). The average diameter of the electro-blown fiber was about 360 nm.

Figure 16A:
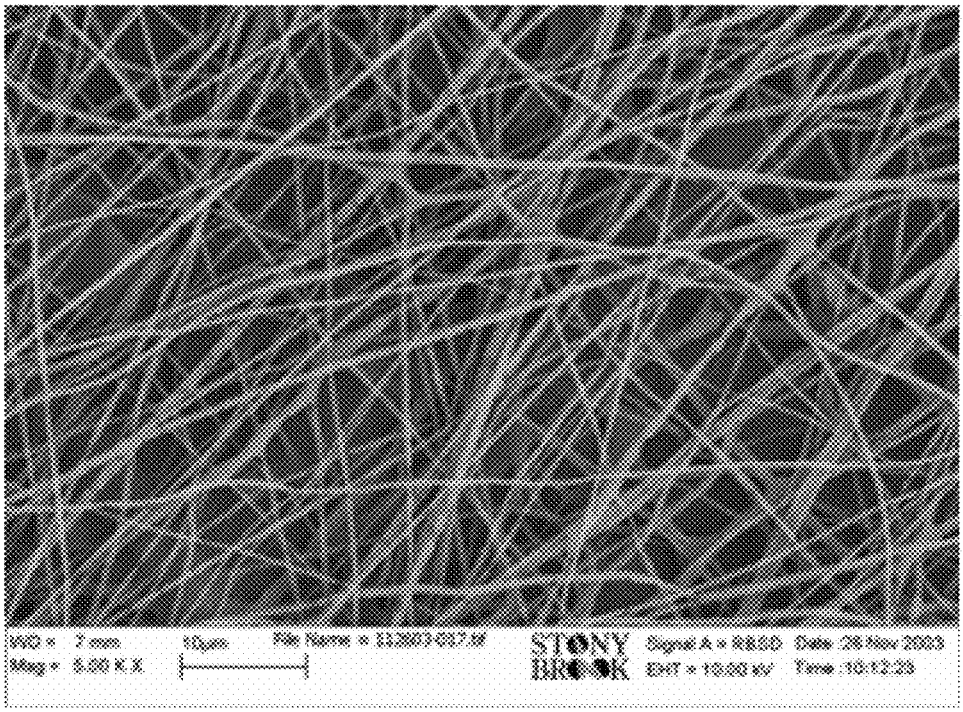
FIGS. 16*a* and 16*b* show how the fiber became thicker and the behavior of re-melt was found, as the polymer flow rate of the PEO solution was changed from 1.5 to 2.5 ml/min/50-spinnerets.
Figure 16B:
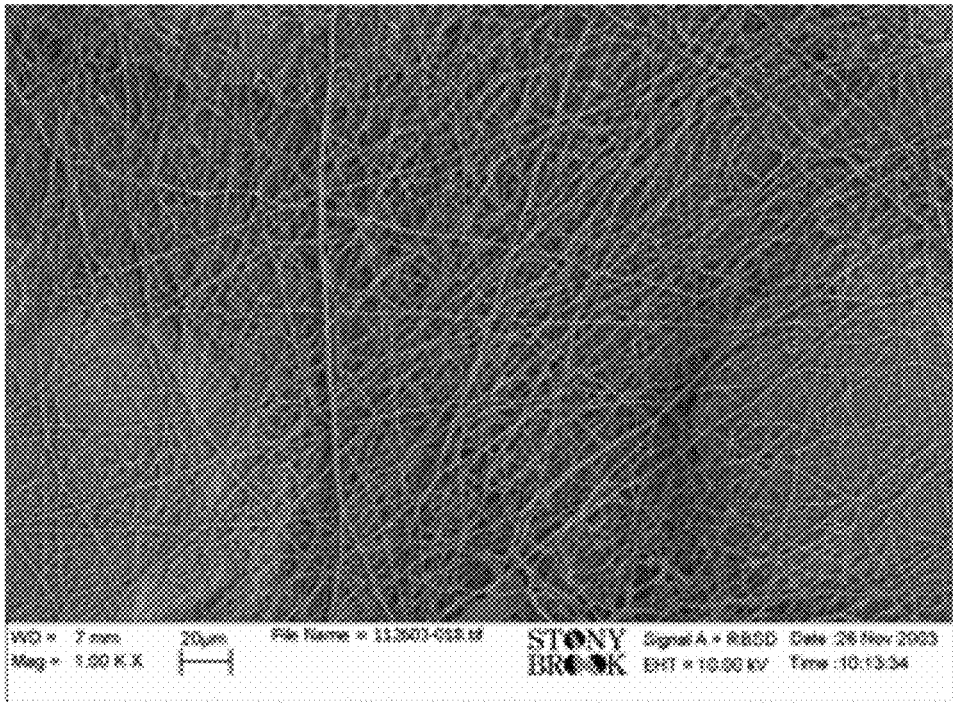

When the polymer flow rate of the PEO solution was changed from 1.5 to 2.5 ml/min/50-spinnerets, the fiber became thicker and the behavior of re-melt was found, as shown in FIGS. 16*a* and 16*b*. However, previous experience has indicated that this problem can be resolved by increasing the air flow temperature. At this configuration, the electrical isolation of the air heaters and their accessories at high voltages had not been implemented. As a result, the air temperature was not changed for this test. It is to be understood that isolation of heaters can be achieved by reversing the polarity of the electrical field.

Figure 17A:
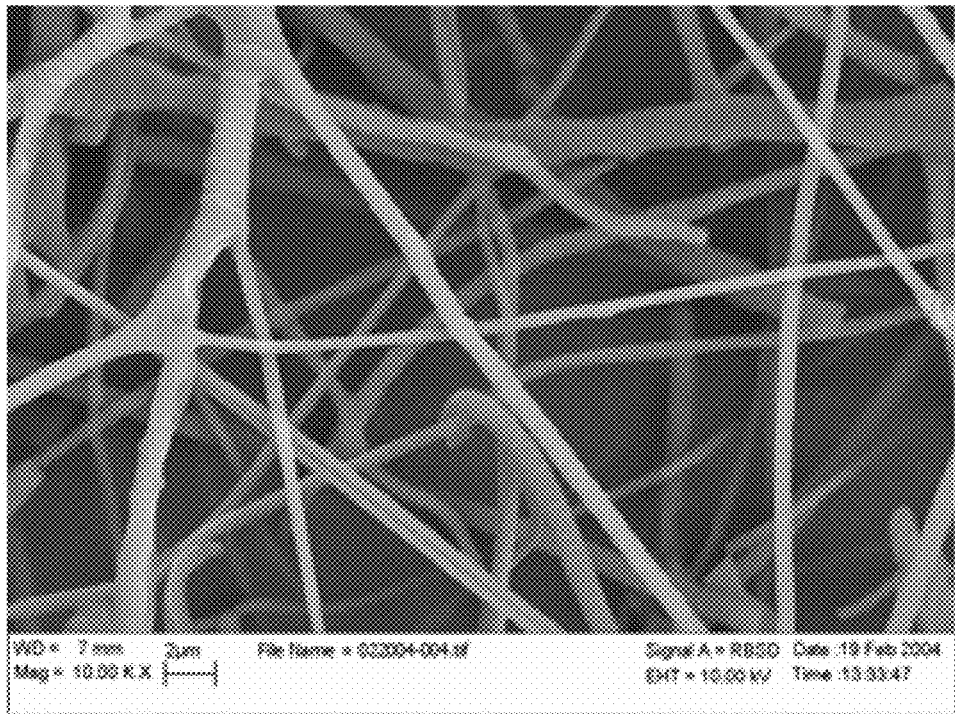
FIGS. 17*a* and 17*b* show SEM images at different scales produced at 25 kV, 1.5 ml/min/50 spinnerets using the high throughput electro-blowing apparatus.
Figure 17B:
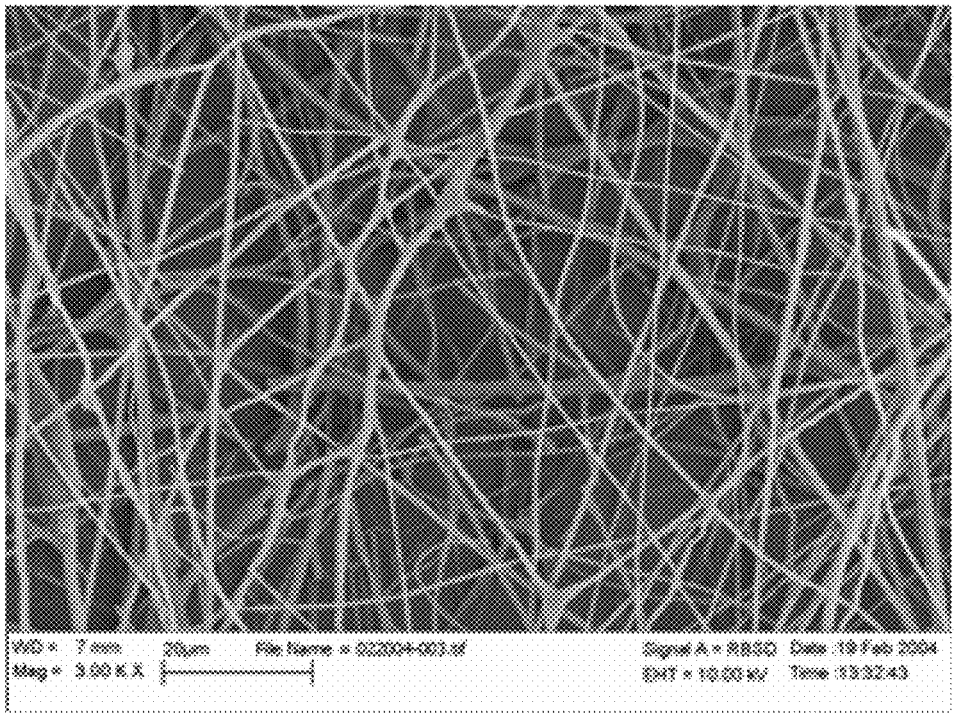

For PEO solution with molecular weight of 2M, the resulting fibers seem to be quite different. FIGS. 17*a* and 17*b* show SEM images at different scales produced at 25 kV, 1.5 ml/min/50 spinnerets using the high throughput electro-blowing apparatus. From these images, it appears that the fiber is not continuous and has a large size distribution. The specific reasons for this morphology is not known, however, it is believed that the concentration was not sufficiently homogeneous (even though the bulk viscosity was relatively high) for a continuous fiber formation.

Electro-Blowing of Polyvinyl Alcohol

Figure 18A:
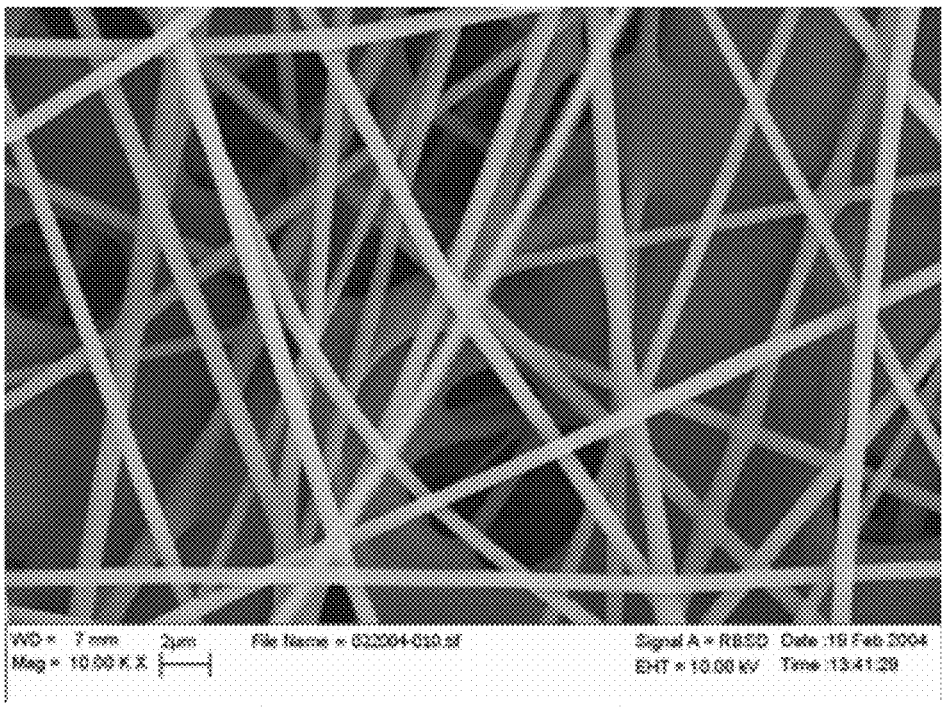
FIGS. 18*a* and 18*b* show SEM images of electro-blowing of PVA (10%, Mw=125 k) at two different scales.
Figure 18B:
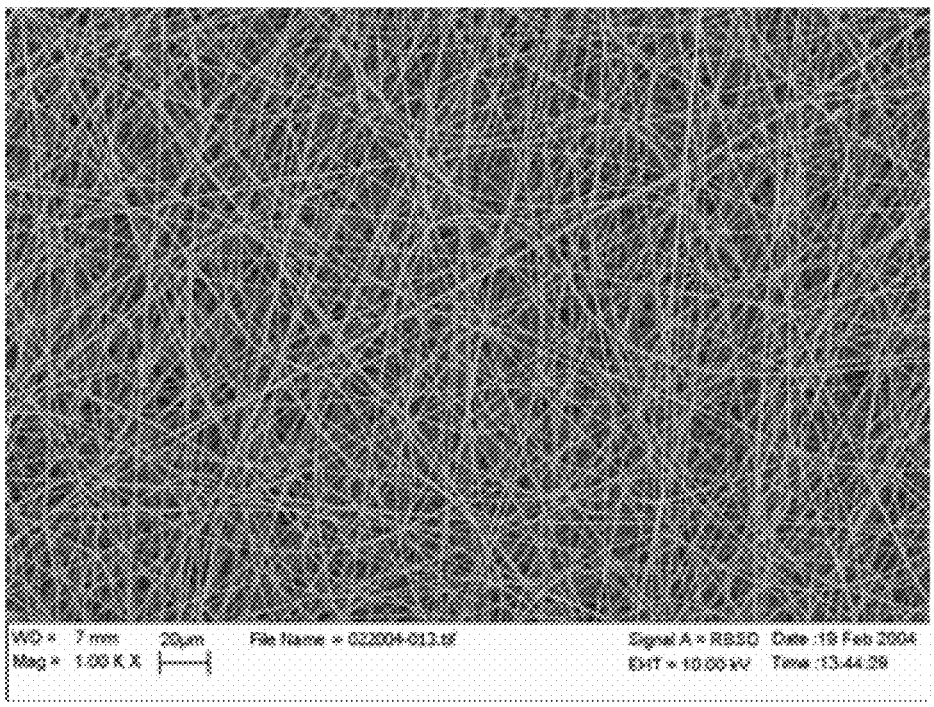

Several conditions for electro-blowing of polyvinyl alcohol (PVA) using the high throughput electro-blowing apparatus were also tested. PVA solution (in water) is very hydrophilic and shows some degree of elasticity (almost like a thick glue). The rheological properties of PVA solution were 10 wt %, Mw=125 k, 88% hydrolyzed. FIGS. 18*a* and 18*b* show SEM images of electro-blowing of PVA (10%, Mw=125 k) at two different scales. It is seen that the fibers size was uniformly distributed and the estimated average diameter of the fibers was about 380 nm. The other processing conditions included a solution flow rate of 1.5 ml/min/50-spinnerets and a high voltage of 28 kV. The average air pressure was 50 psi.

Figure 19A:
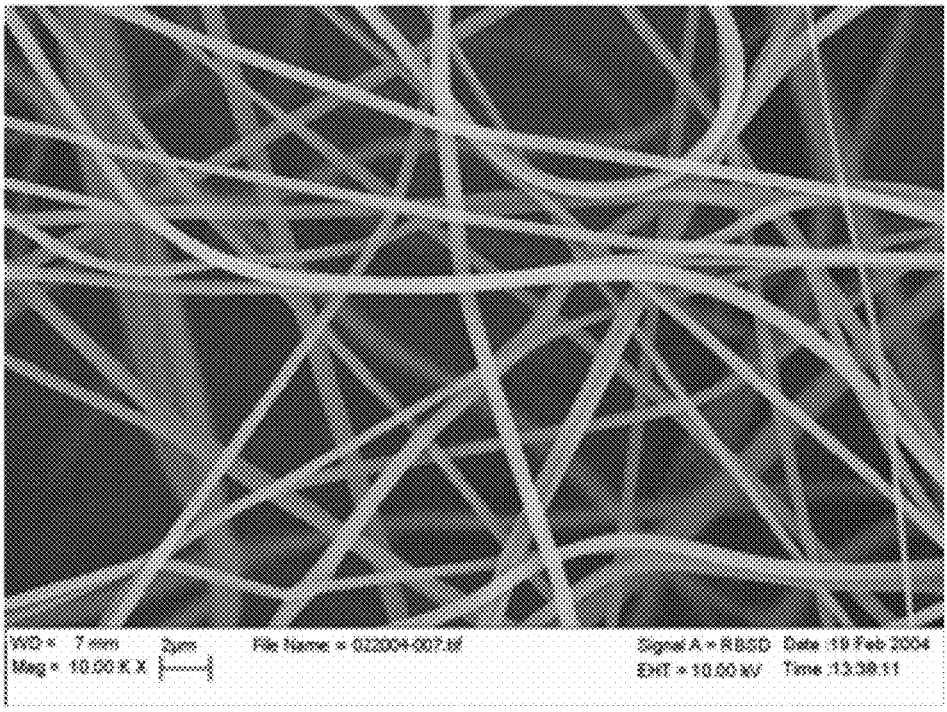
FIGS. 19*a* and 19*b* show SEM images at different scales.
Figure 19B:
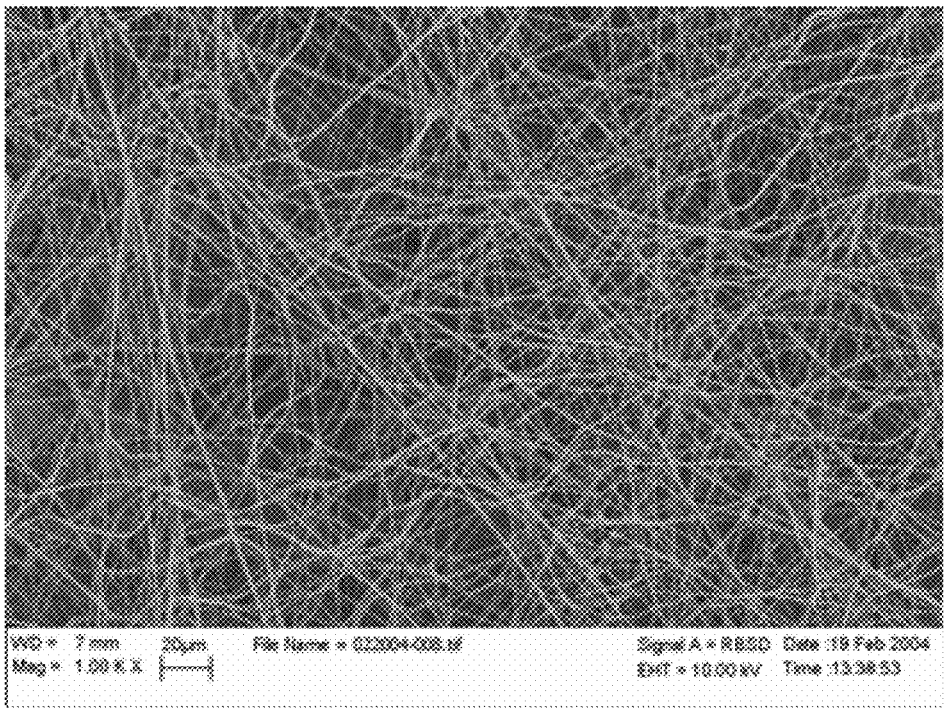

A lower molecular weight PVA solution (10 wt % in water, Mw=78 k, 88% hydrolyzed) was also tested. The viscosity of this solution was significantly lower. FIGS. 19*a* and 19*b* show SEM images at different scales. The other operating conditions were similar to the previous PVA solution. By comparison of FIGS. 18*a* and 18*b* and FIGS. 19*a* and 19*b*, it can be observed that due to the lower viscosity (and therefore the elasticity), there is no re-melt taking places in electro-blowing of lower molecular weight PVA solution.

Electro-Blowing of Polyvinyl Pyrrolidone

Figure 20A:
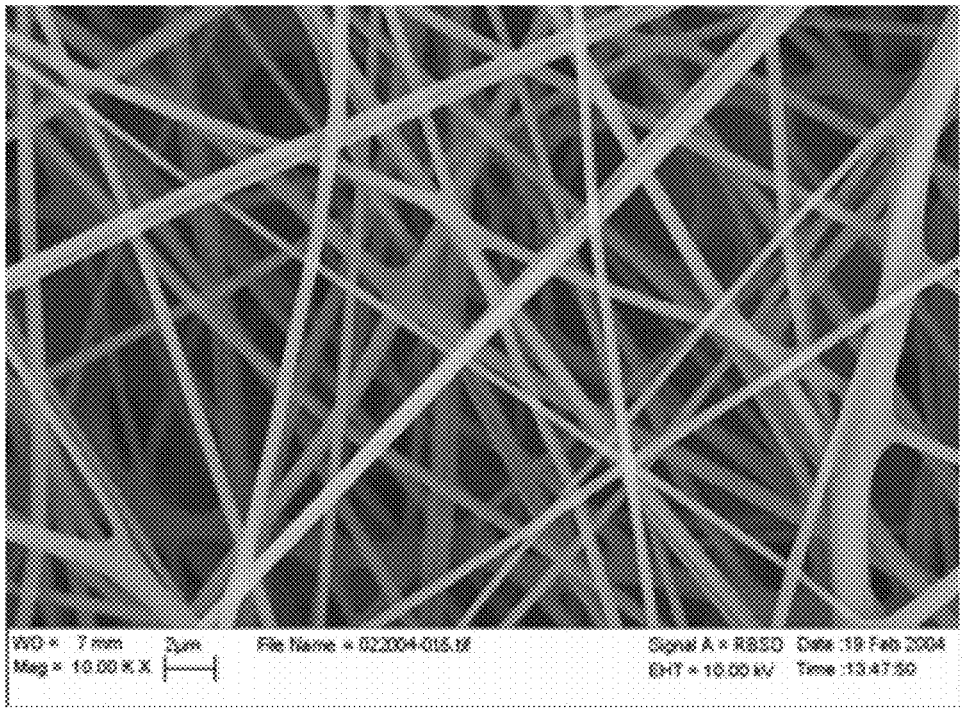
FIGS. 20*a* and 20*b* show SEM images of electro-blown PVP membrane under the same experimental conditions as those of the PVA solution.
Figure 20B:
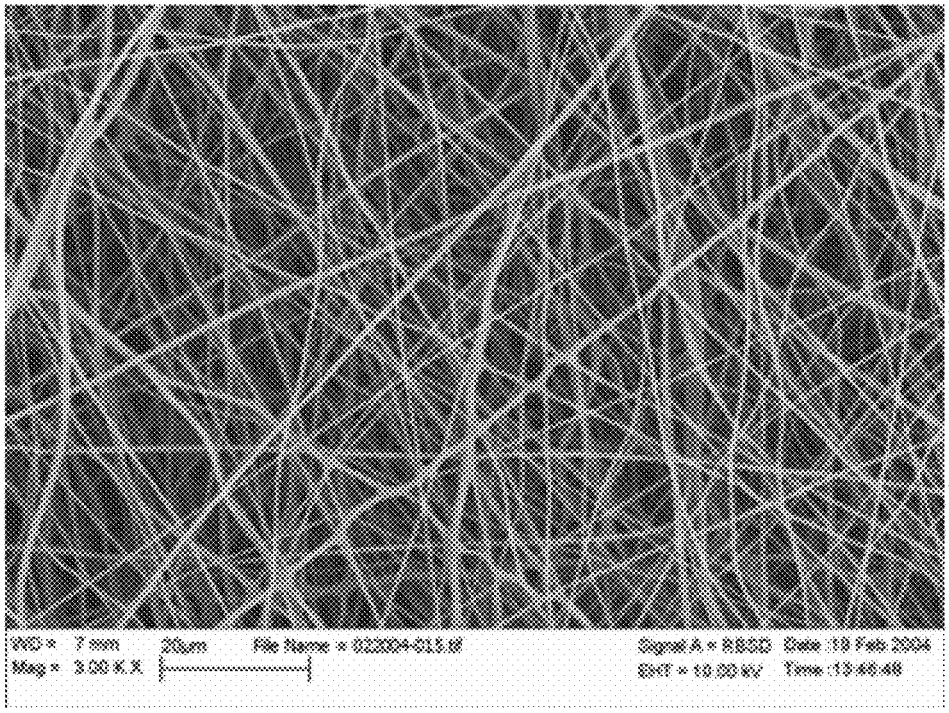

The polyvinyl pyrrolidone (PVP) has unique properties of a relatively low viscosity but strong hydrophilicity. The PVP solution (in water) had a concentration of 20 wt % with Mw of 1 M. Even though the viscosity of the prepared PVP solution was about the same as the PVA (10 wt %, Mw=125 k), the PVP solution was not as sticky as the PVA solution. FIG. 20 shows SEM image of electro-blown PVP membrane under the same experimental conditions as those of the PVA solution. The processing conditions included a solution flow rate of 1.5 ml/min/50-spinnerets, and a high voltage of 28 kV. The average air pressure was 50 psi. As shown in FIGS. 20*a* and 20*b*, the fiber size distribution was larger even though there was no re-melt occurring. The average diameter of the electro-blown fiber was about 420-480 nm.

Electrical Field Reversal for Electro-Blowing of Polyvinyl Pyrrolidone

Figure 21A:
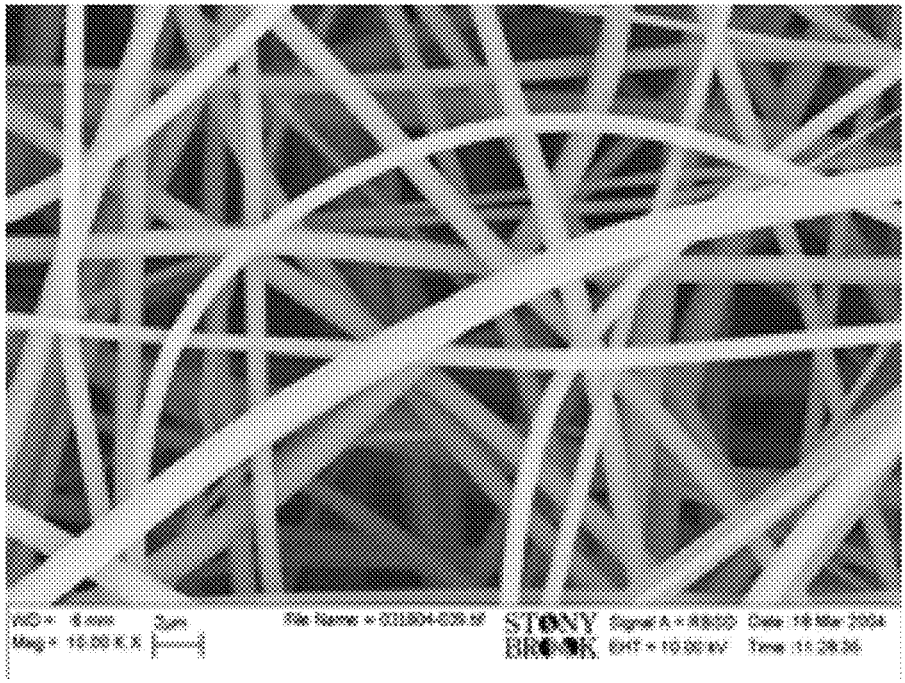
FIGS. 21*a* and 21*b* show SEM images of a membrane made by electro-blowing using a configuration of electrical field reversal with a 15% PVP solution in water.
Figure 21B:
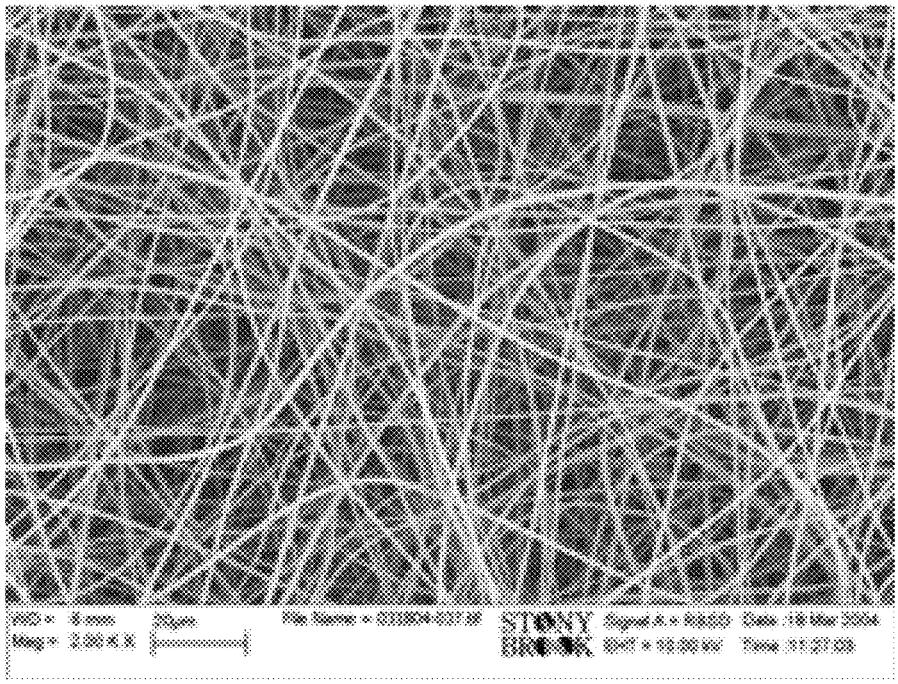

FIGS. 21*a* and 21*b* show SEM images of a membrane made by electro-blowing using a configuration of electrical field reversal with a 15% PVP solution in water. The operating conditions included a 35 kV voltage, 1.5 ml/min/50-spinnerets and 20 cm distance between spinneret block and collection target. Other processing conditions included a high voltage of about 28 kV, and an average air pressure of 50 psi. The average diameter of the electro-blown fiber was about 450-500 nm.

Numerous additional modifications and variations of the present invention are possible in light of the above teachings. It is therefore to be understood that within the scope of the appended claims, the present invention may be practiced otherwise than as specifically described herein.

1. Zeleny, J., Phys. Rev. 1914. 3: p. 69-91.
2. Formhals, A., Process and Apparatus for Preparing Artificial Threads, US patent 1934: U.S. Pat. No. 1,975,504.
3. Taylor, G. I., Proc. Roy. Soc. Lond. A. 1969.31: p. 453-475.

Uniaxial or Biaxial Orientation of Electrospun/Electroblown Membranes

The morphology of a typical electrospun membrane (e.g. Polyglycolide (PLGA) spun from 20% DMF solution under 25 kV electrical field) is shown in FIG. 22. The following post-treatment procedures were applied to this membrane. The as-spun membrane was placed in a vacuum oven to completely remove the residual solvent. The membrane was then annealed at different temperatures (60, 70, 80 and 90° C.) under tension (frame dry) for different time periods (10, 20, 30 and 60 min). An effective annealing temperature was 5° C. above the glass transition temperature of the electrospun membrane. The membrane could be simultaneously or sequentially drawn in uniaxial or biaxial directions to improve crystallinity and orientation of the nanofibers. The chosen applied strain for treating the PLGA membrane ranged from 20% to 300%, the chosen temperature ranged from room temperature to 120° C.

A representative morphology of the uniaxially drawn and annealed PLGA membrane is shown in FIG. 23, exhibiting a different mean value of porosity and distribution, as well as fiber orientation (the annealing temperature was 90° C., the applied strain was 450% and the annealing time was 20 min). A representative morphology of the simultaneous biaxially drawn and annealed PLGA membrane is shown in FIG. 24, exhibiting a different mean value of porosity and distribution. (the annealing temperature was 90° C., the applied strain was 200% in each direction and the annealing time was 20 min). The physical strength and mechanical stability of the treated membrane was also found to have increased significantly. (e.g. the Young's moduli of the uniaxially/biaxially oriented and annealed samples are 2 times higher than that of the as-spun sample, and the yield stress values of the uniaxially/biaxially oriented and annealed samples are 10 times higher).

The invention claimed is:

1. An apparatus configured to form a polymer fiber, comprising:

a spinneret comprising:

a spinneret body defining a retaining void configured to retain one of a polymer solution and a polymer melt and defining a delivery void configured to deliver the one of the polymer solution and the polymer melt from the spinneret body;

a target configured to receive the one of the polymer solution and the polymer melt from the spinneret;

a ground potential source connected to the spinneret and configured to maintain the spinneret at or near ground potential;

a voltage source connected to the target and configured to maintain the target at a voltage above the voltage at which the spinneret is held;

a conveyor disposed on the target and configured to receive the one of the polymer solution, from which solvent has been essentially evaporated, and the polymer melt, wherein the conveyor is a conveyer belt formed of a non-conducting sheet; and at least one grounding unit configured to contact the conveyor and to remove an excess built-up charge from the conveyor.

2. The apparatus according to claim 1, wherein the conveyor comprises an endless belt.

3. The apparatus according to claim 1, wherein the target is supported by at least one column configured to electrically isolate the target.

4. The apparatus according to claim 1, wherein the target comprises a metal material.

5. The apparatus according to claim 1, further comprising:

a path body disposed apart from the spinneret body to define a gap there-between; and a gas source configured to deliver a compressed gas to the gap.

6. The apparatus according to claim 5, further comprising:

at least one heat lamp configured to prevent undesired solidification of the polymer solution before receipt on the target.

7. The apparatus according to claim 6, wherein the at least one heat lamp defines a first zone adjacent the spinneret and a second zone adjacent the target having a temperature less than a temperature of the first zone.

8. The apparatus according to claim 1, wherein the at least one grounding unit comprises a plurality of rollers.

9. The apparatus according to claim 8, wherein the plurality of rollers are connected to a ground potential source configured to maintain the rollers at or near ground potential.

10. The apparatus according to claim 1, wherein the spinneret comprises a discharge needle disposed in the spinneret body, the discharge needle comprising an upper portion and a tip portion connected to the upper portion, the upper portion having a diameter about equal to a diameter of the delivery void, and the tip portion having a diameter less than the diameter of the upper portion, the upper portion configured to move between a first position disposed outside the delivery void and a second position disposed within the delivery void.

11. The apparatus according to claim 1, wherein the spinneret comprises a cleaning unit disposed outside of the spinneret body, the cleaning unit configured to move adjacent an exterior surface of the spinneret body and to remove an at least partially solidified polymer from the exterior surface of the spinneret body.

* * * * *